US011437003B2

(12) United States Patent
Kebrle

(10) Patent No.: US 11,437,003 B2
(45) Date of Patent: Sep. 6, 2022

(54) TORSIONAL BASED TREMOLO SYSTEM WITH A STATIONARY BRIDGE

(71) Applicant: John Michael Kebrle, Dallas, TX (US)

(72) Inventor: John Michael Kebrle, Dallas, TX (US)

( * ) Notice: Subject to any disclaimer, the term of this patent is extended or adjusted under 35 U.S.C. 154(b) by 0 days.

(21) Appl. No.: 17/249,403

(22) Filed: Mar. 1, 2021

(65) Prior Publication Data

US 2021/0272540 A1 Sep. 2, 2021

Related U.S. Application Data

(60) Provisional application No. 62/983,735, filed on Mar. 1, 2020.

(51) Int. Cl.

| | |
|---|---|
| ***G10D 3/12*** | (2020.01) |
| ***G10D 1/08*** | (2006.01) |
| ***G10D 3/153*** | (2020.01) |
| ***G10D 3/04*** | (2020.01) |

(52) U.S. Cl.

CPC ..... *G10D 3/12* (2013.01); *G10D 1/08* (2013.01); *G10D 3/04* (2013.01); *G10D 3/153* (2020.02)

(58) Field of Classification Search

CPC .. G10D 3/12; G10D 1/08; G10D 3/04; G10D 3/153; G10D 3/00

See application file for complete search history.

(56) References Cited

U.S. PATENT DOCUMENTS

| | | | |
|---|---|---|---|
| 3,241,418 | A | 3/1966 | Fender |
| 3,248,991 | A | 5/1966 | Cole |
| 3,326,072 | A | 6/1967 | Price |
| 3,396,284 | A | 8/1968 | Scherer |
| 3,407,696 | A | 10/1968 | Smith et al. |
| 3,990,341 | A | 11/1976 | Pace |
| 4,135,426 | A | 1/1979 | Rickard |
| 4,141,271 | A | 2/1979 | Mullen |
| 4,171,661 | A | 10/1979 | Rose |
| 4,285,262 | A | 8/1981 | Scholz |
| 4,354,417 | A | 10/1982 | Glaser |
| 4,361,068 | A | 11/1982 | Schaller |
| 4,457,201 | A | 7/1984 | Storey |
| 4,497,236 | A | 2/1985 | Rose |
| 4,516,462 | A | 5/1985 | Schulze |
| 4,549,461 | A | 10/1985 | Rose |
| 4,555,970 | A | 12/1985 | Rose |
| 4,563,934 | A | 1/1986 | Keizer |
| 4,632,004 | A | 12/1986 | Steinberger |
| 4,674,389 | A | 6/1987 | Fender |

(Continued)

OTHER PUBLICATIONS

Notice of Allowance, dated Oct. 4, 2021, by the USTPO, re U.S. Appl. No. 17/249,402.

*Primary Examiner* — Kimberly R Lockett
(74) *Attorney, Agent, or Firm* — Bill R. Naifeh

(57) ABSTRACT

Disclosed is a torsion based tremolo apparatus that uses a cylinder assembly to rotate part of the tremolo apparatus relative to a baseplate. The baseplate is used to mount the tremolo apparatus to a musical instrument, such as a guitar. A bridge string support assembly is coupled to the baseplate and, combined with a string holder, supports a string of the musical instrument. A torsion device is positioned to impart torsional force on the cylinder assembly relative to the baseplate. The string holder is coupled to the cylinder assembly and rotates when the cylinder assembly is rotated.

20 Claims, 27 Drawing Sheets

(56) References Cited

U.S. PATENT DOCUMENTS

| | | | | |
|---|---|---|---|---|
| 4,882,967 | A | 11/1989 | Rose | |
| 4,915,006 | A | 4/1990 | Steinberger | |
| 4,955,275 | A | 9/1990 | Gunn | |
| 4,967,631 | A | 11/1990 | Rose | |
| 4,993,300 | A | 2/1991 | Ejen | |
| 5,046,393 | A | 9/1991 | Xenidis | |
| 5,497,690 | A | 3/1996 | Soupios | |
| 5,637,818 | A | 6/1997 | Fishman et al. | |
| 5,864,074 | A | 1/1999 | Hill | |
| 7,459,619 | B2 | 12/2008 | Gawenda | |
| 2007/0169609 | A1 * | 7/2007 | Gawenda ..... | G10D 3/153<br>84/322 |
| 2008/0229900 | A1 | 9/2008 | Steinberger | |

* cited by examiner

TORSIONAL BASED TREMOLO SYSTEM WITH A STATIONARY BRIDGE

CLAIM OF PRIORITY AND INCORPORATION BY REFERENCE

This application claims the benefit of U.S. Provisional Application Ser. No. 62/983,735, filed on Mar. 1, 2020, and entitled A TORSIONAL BASED TREMOLO SYSTEM AND APPARATUS FOR INCREASING OR DECREASING THE TENSION AND PITCH OF THE STRINGS OF A MUSICAL INSTRUMENT, which is hereby incorporated by reference in its entirety.

TECHNICAL FIELD

The invention relates in general to musical instruments and in particular to an improved tremolo system for string musical instruments.

BRIEF DESCRIPTION OF THE DRAWINGS

For a more complete understanding, reference is now made to the following description taken in conjunction with the accompanying Drawings in which.

DETAILED DESCRIPTION

Figure 1A:
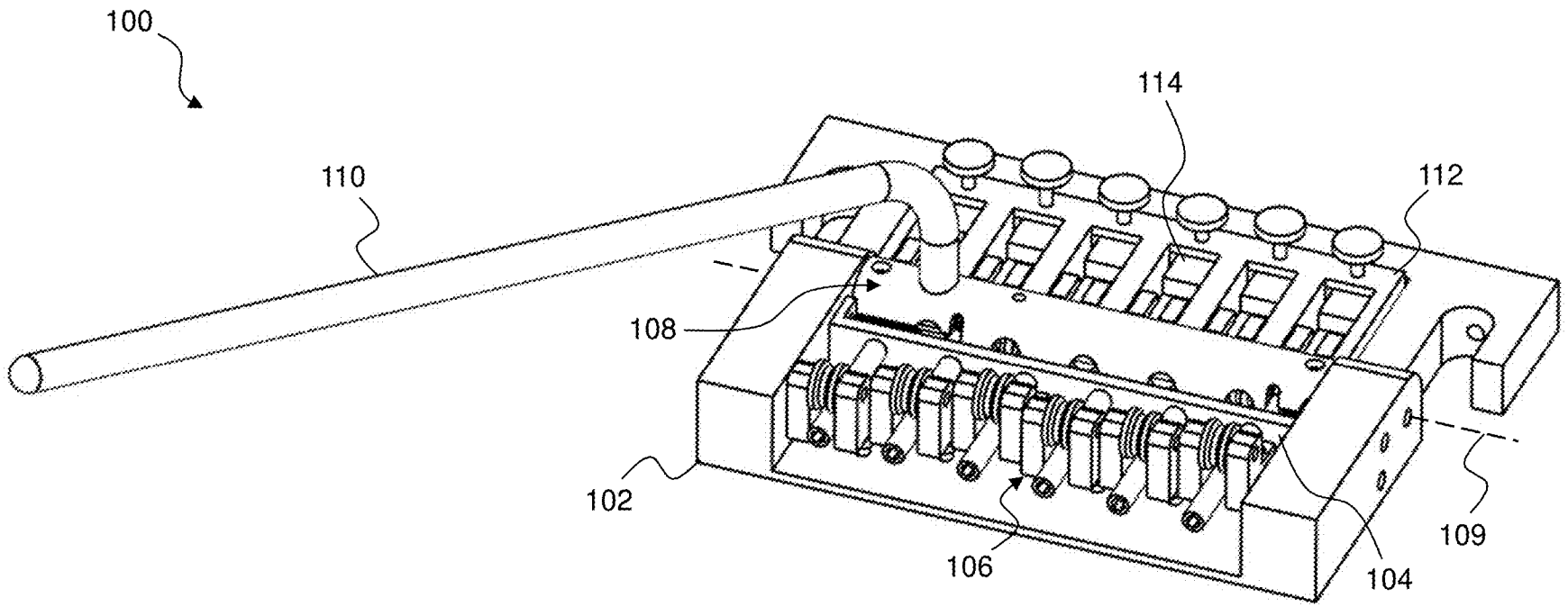
FIGS. 1A-1I illustrate various views of one embodiment of a tremolo apparatus.

Specific examples of components and component arrangements are described below to simplify the present disclosure. These are, of course, merely examples and are not intended to limit the invention from that described in the claims. Well-known elements may be presented without detailed description in order not to obscure the present invention in unnecessary detail. For the most part, details unnecessary to obtain a complete understanding of the present invention have been omitted inasmuch as such details are within the skills of persons of ordinary skill in the relevant art.

When directions, such as upper, lower, top, bottom, clockwise, counterclockwise, are discussed in this disclosure, such directions are meant to only supply reference directions for the illustrated figures and for orientation of components in the figures unless specifically stated otherwise. The directions should not be read to imply actual directions used in any resulting invention or actual use. Under no circumstances should such directions be read to limit or impart any meaning into the claims.

Referring to FIGS. 1A-1I, one embodiment of a tremolo apparatus 100 is illustrated from different viewing angles. The tremolo apparatus 100 is configured to be attachable to a string musical instrument without requiring modification of the instrument. For example, the tremolo apparatus 100 may be surface mounted using existing mounting holes intended for an instrument's bridge or tailpiece. It is understood, however, that in other embodiments modifications may be made to the musical instrument prior to mounting the tremolo assembly 100.

For purposes of example, the tremolo apparatus 100 is described with respect to its use with a guitar and the figures generally illustrate the tremolo apparatus as configured to interact with six separate strings of the instrument. However, for other numbers of strings, additional components may be added or removed, or some illustrated components may remain unused if not needed.

The tremolo apparatus 100 operates as a torsion device, rather than a tension or compression device, in order to simultaneously decrease or increase the tension on all of the strings of a musical instrument. In operation, this is accomplished by moving a portion of the tremolo apparatus 100 from a first position to a second position in either an upward or downward motion. This, in turn, increases or decreases the tension of the musical instrument's strings. Generally, the tremolo apparatus 100 uses torsion about an axis as a means of regulating and modulating the tension of the strings, rather than using tension or compression springs to generate a moment about the axis to counteract the tension and modulate the tension of the strings.

Many tremolos require significant modification of the musical instrument, generally being mounted into a cavity on the bottom side of the tremolo and often requiring cavities on both the front and back of the instrument. These modifications are generally undesirable for a number of reasons, including, but not limited to, significant alterations affect the tonal qualities of the instrument and increase the manufacturing costs of the instrument in that creating these cavities cost time and money, and may require significant adjustment.

The design of the tremolo apparatus 100 generally enables a surface mount and does not require significant modification of the instrument, permanent modification of the instrument, or removal of material from the instrument in the form of a cavity. Accordingly, the tonal qualities of the instrument are generally not altered when using the tremolo apparatus 100.

With specific reference to FIG. 1A, the tremolo apparatus 100 includes a baseplate 102 that forms a foundation for the various components of the tremolo. A bridge backing plate 104 is immovably coupled to the baseplate 102, and is itself used to secure one or more bridge string assemblies 106. A cylinder assembly 108 is rotatably coupled to the baseplate 102 and may be coupled to a tremolo arm 110 (e.g., a lever arm) or by other means. It is understood that the tremolo arm 110 is not limited to that shown and may, for example, be of many different shapes and have differing numbers and angles of curves. A back bracket 112 is coupled to the cylinder assembly 108 and rotates when the cylinder assembly 108 is rotated. String holders 114 are retained by the back bracket 112.

The cylinder assembly 108 and back bracket 112 may rotate relative to the base plate 102, bridge backing plate 104, and bridge string assemblies 106 around an axis 109 when force is applied, such as through the tremolo arm 110. The baseplate 102 forms the base for a tremolo mechanism that includes bridge string assemblies 106 and string holders 114 that are used to secure and tune strings of the musical instrument. The cylinder assembly 108, when forced via the arm 110, rotates around the axis 109, thereby increasing or decreasing the tension on the strings depending on the direction of rotation. FIG. 1A illustrates the cylinder assembly 108 in a first position relative to the baseplate 102.

Figure 1B:
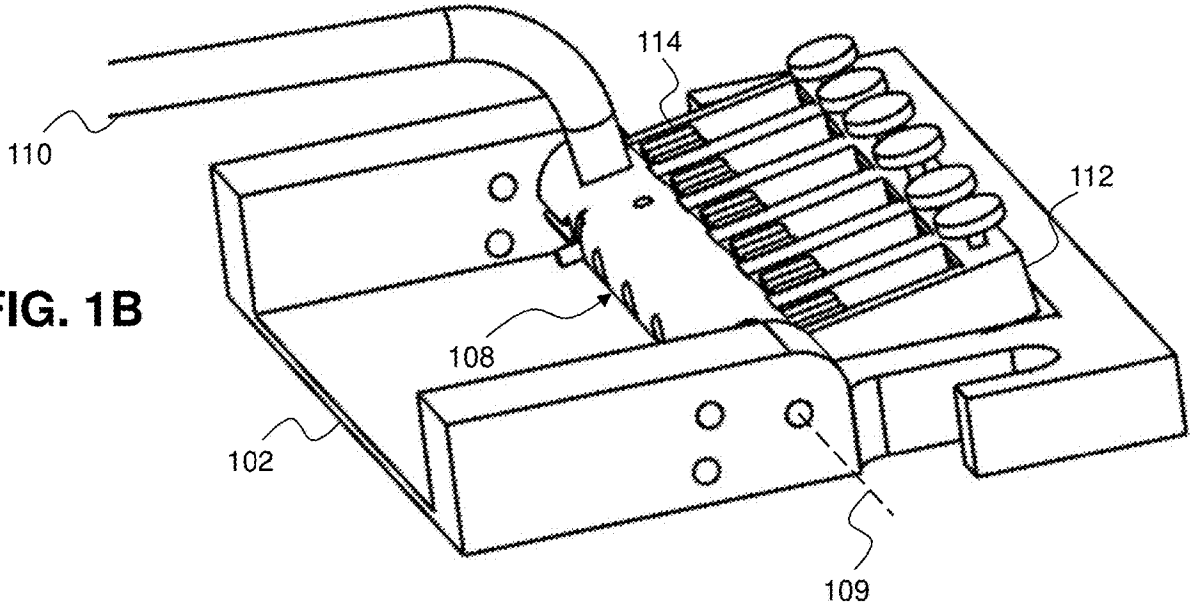
Figure 1C:
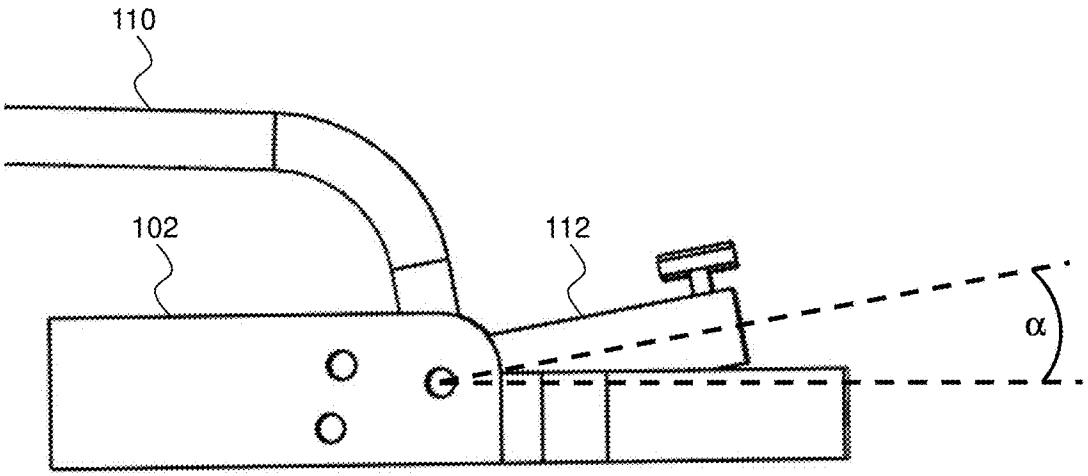

With additional reference to FIGS. 1B and 1C, the cylinder assembly 108 is illustrated in a second position relative to the baseplate 102 following rotation of the cylinder assembly 108 around the axis 109. The bridge backing plate 104 and bridge string assemblies 106 do not rotate with the cylinder assembly 108 and have been omitted from FIGS. 1B and 1C for purposes of clarity. An angle of rotation a may vary based on settings applied to the tremolo apparatus and/or based on the particular design of the baseplate 102, the cylinder assembly 108, and/or other components. For example, a stop may be integrated into or provided for the tremolo apparatus 100 to limit the available rotational range. It is understood that the use of first and second positions is for purposes of example and there may be multiple rotational positions.

Figure 1D:
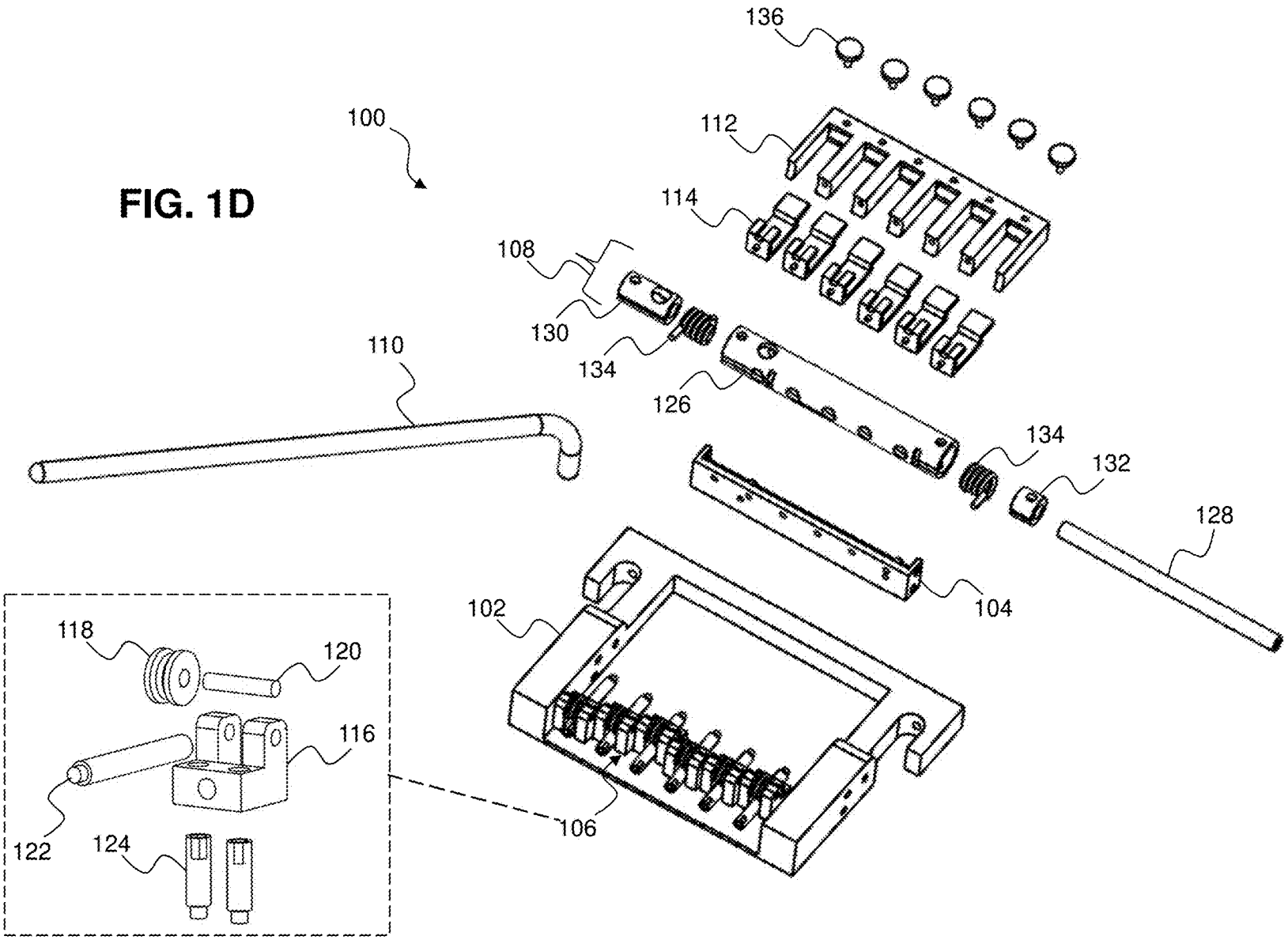
Figure 1E:
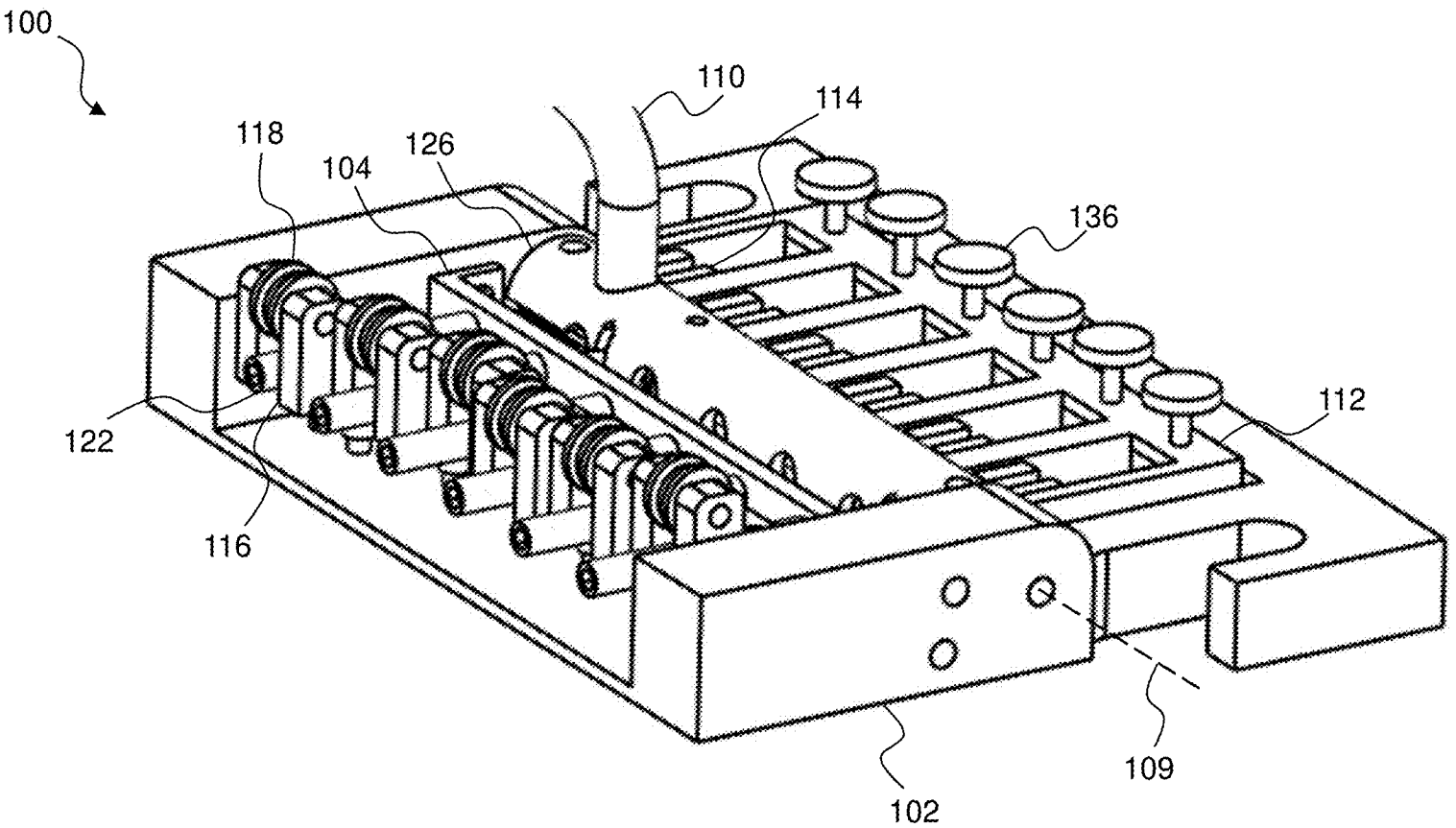
Figure 1F:
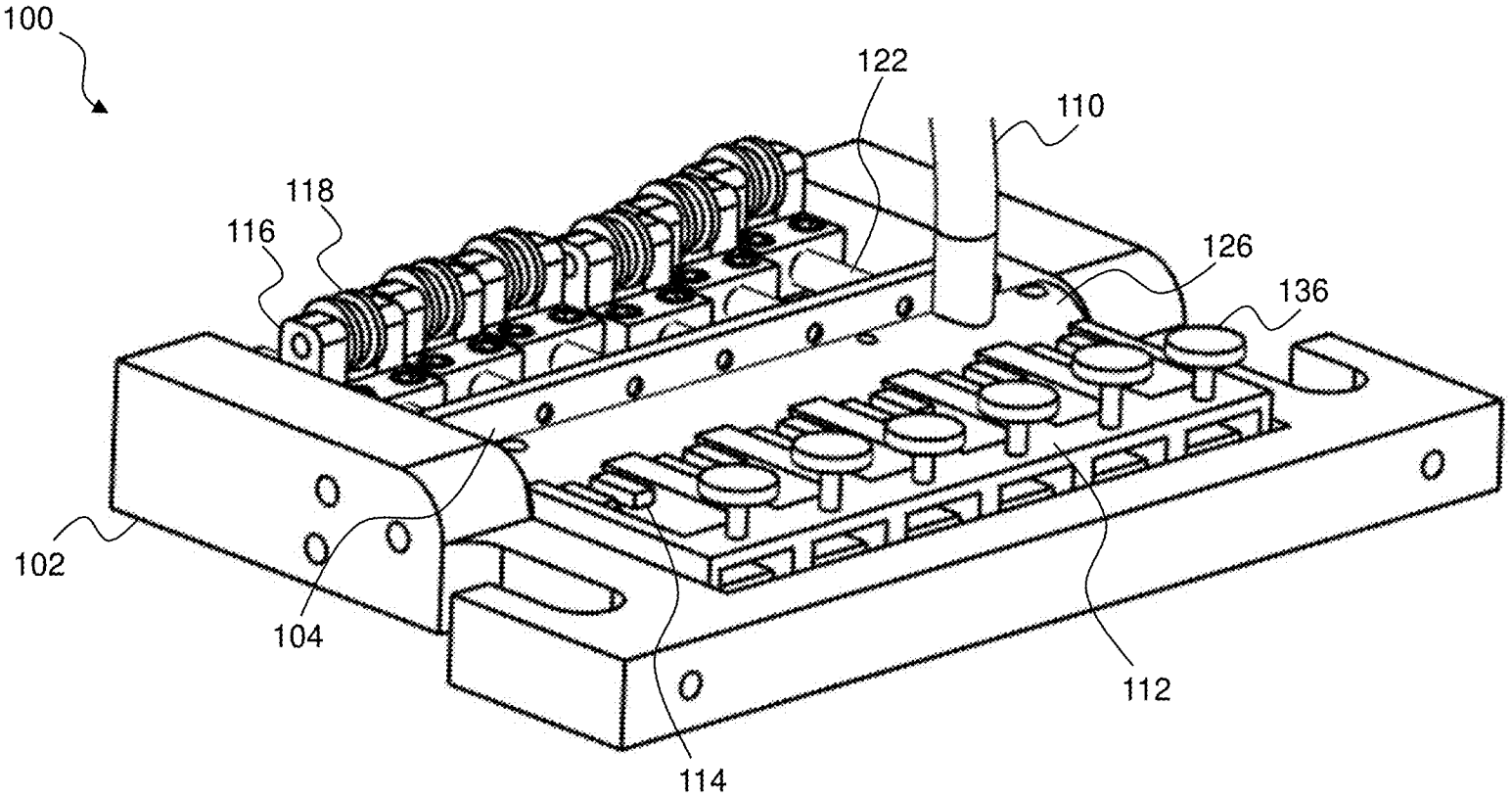
Figure 1G:
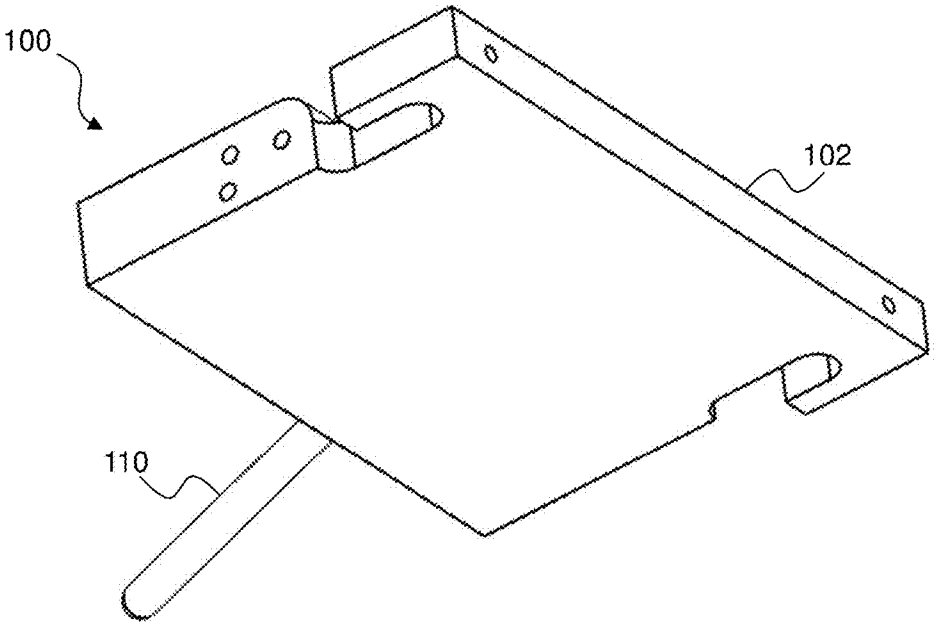
Figure 1H:
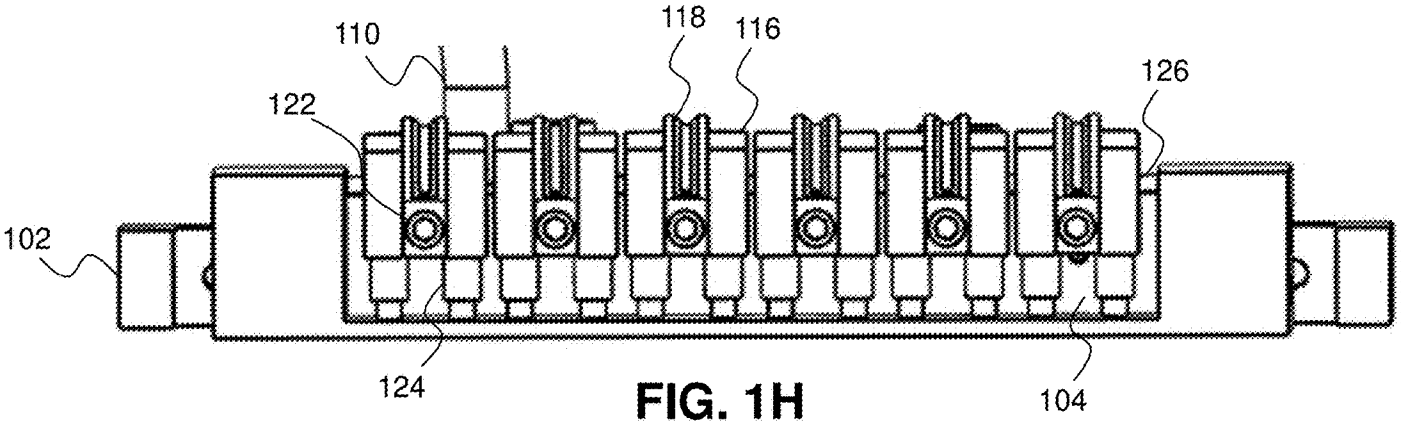
Figure 1I:
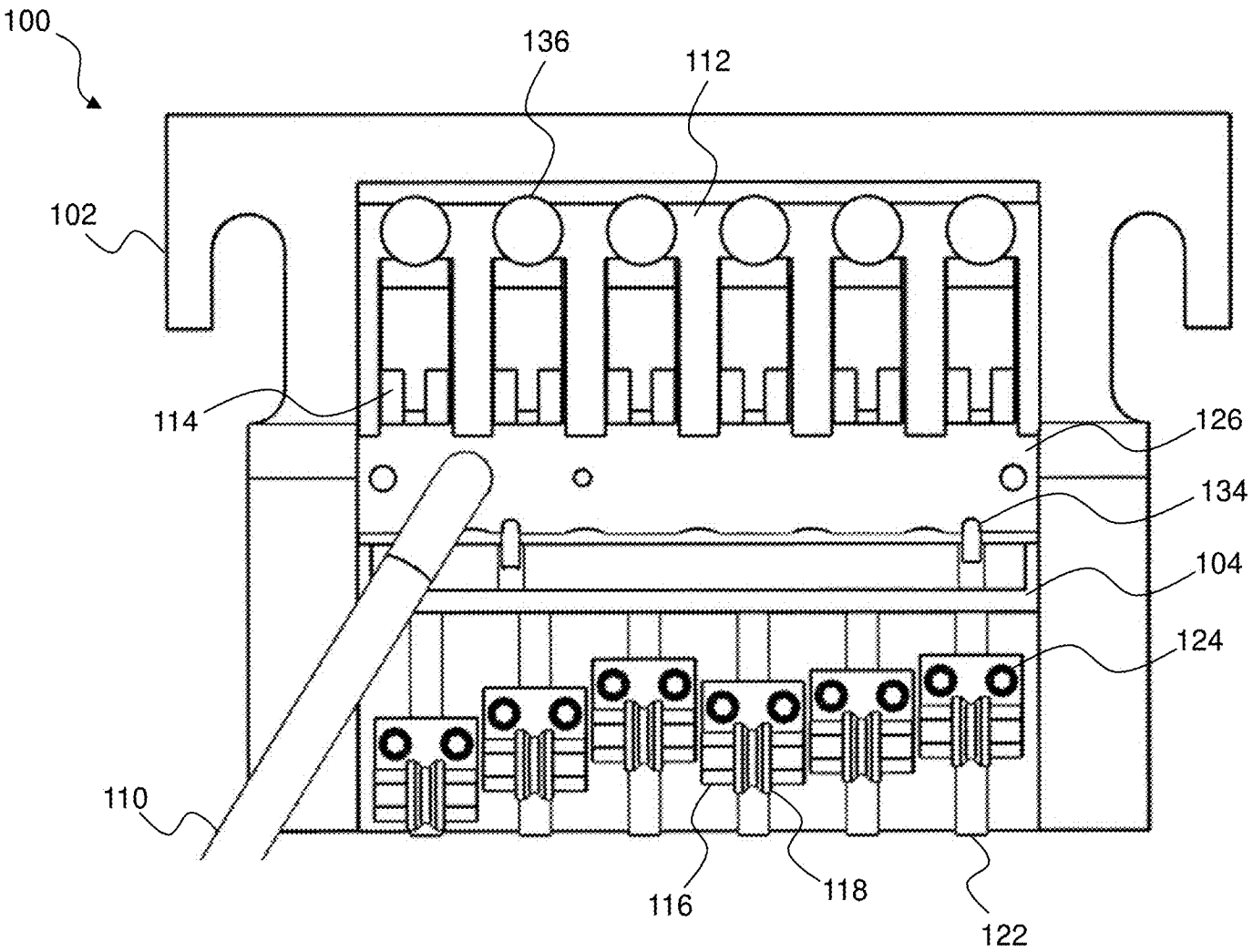

With additional reference to FIG. 1D, the tremolo apparatus 100 is shown in an exploded view with each bridge string assembly 106 including a bridge bracket 116 that rotatably engages a bridge string support 118 using a pin 120. A bridge tuning set screw 122 and one or more bridge height set screws 124 may be used to adjust the positioning of the bridge bracket 116 relative to the bridge backing plate 104 and the baseplate 102. In other embodiments, the six illustrated bridge string assemblies 106 may be combined in various ways to form a single assembly, pairs or trios of assemblies, or in other ways.

The cylinder assembly 108 includes a cylinder 126 into which an axle 128 is inserted. End caps 130 and 132 aid in capturing one or more torsion devices (e.g., springs) 134 within the cylinder 126. The torsion spring or springs 134 may be used to apply torsional force around the axis of rotation 109. The springs 134 may be used to bias the cylinder assembly 108 in either direction of rotation relative to the baseplate 102. It is understood that springs are used for purposes of example and that many different torsion devices may be used in addition to, or instead of, the illustrated springs.

Not shown in FIG. 1D are various fasteners. For example, four screws may be used to couple the cylinder 126 to the back bracket 112. Two screws (four total) may be used to couple the end caps 130 and 130 to the cylinder 126 and the axle 128. Four screws may be used to couple the bridge backing plate 104 to the baseplate 102. One or more pins may be used to rotatably couple the axle 128 to the baseplate 102.

It is understood that the screws described herein may be replaced by any other suitable fastener, and may be in various forms (e.g., thumbscrews intended for manipulation via fingers and/or various screwhead configurations intended for manipulation via tools). Furthermore, it is understood that some openings may be replaced by a threaded screw or a similar mechanism that is to be engaged by a nut or another fastener.

Figure 2:
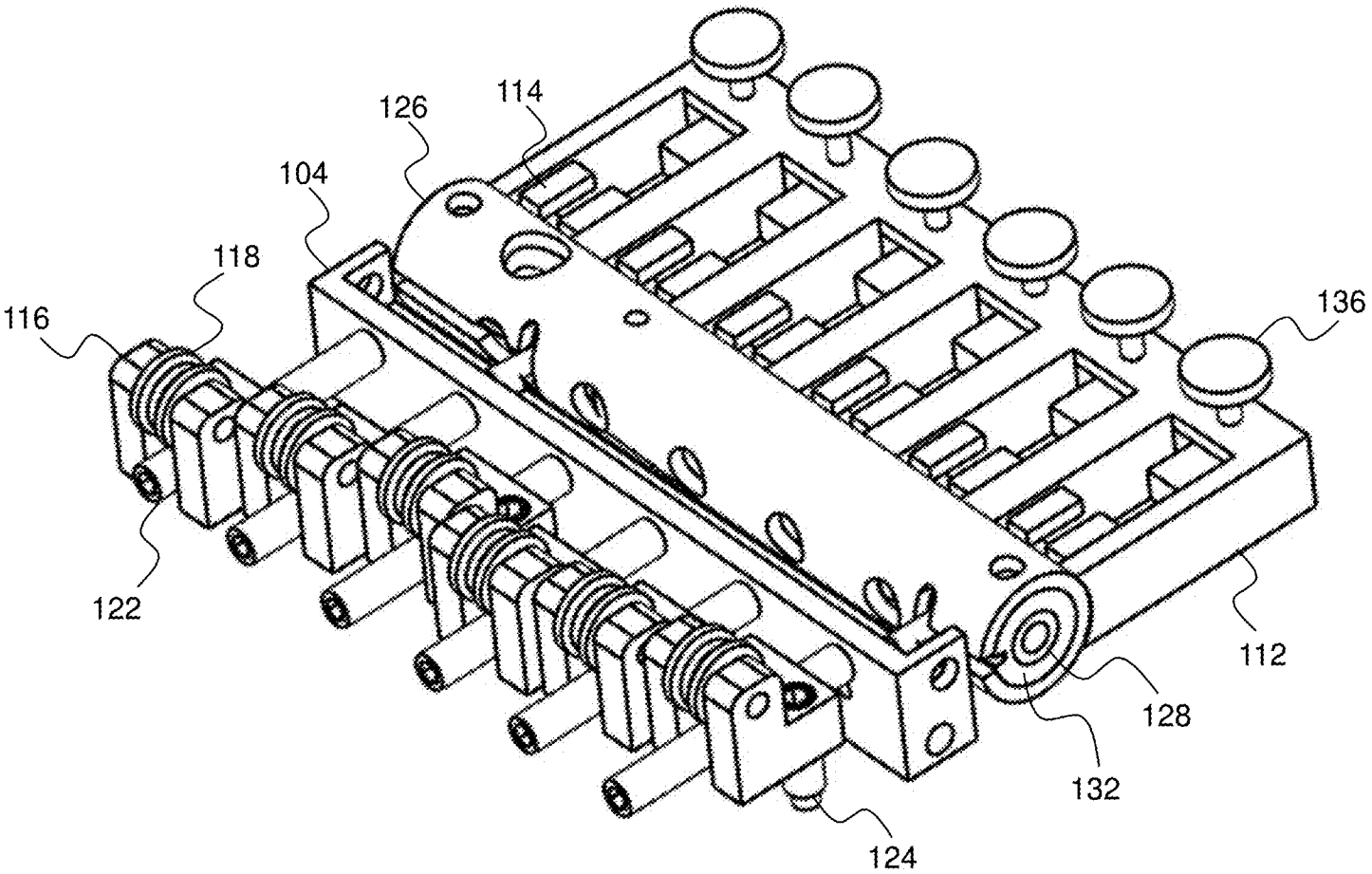
FIGS. 2-5 illustrate the tremolo apparatus of FIGS. 1A-1I with various components omitted.

Referring to FIG. 2, one embodiment of the tremolo apparatus of FIGS. 1A-1I is illustrated with the baseplate 102 omitted.

Figure 3:
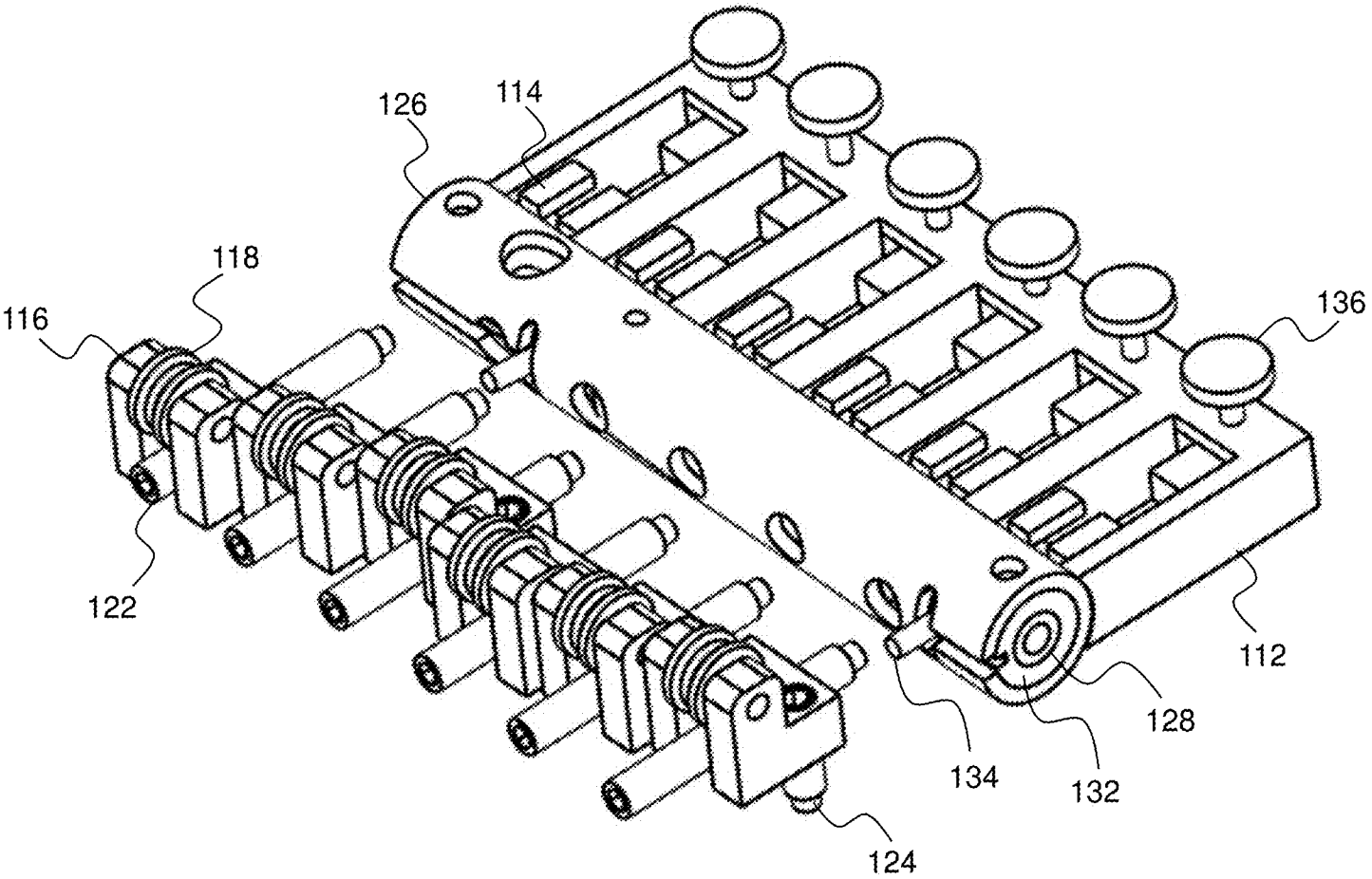

Referring to FIG. 3, the tremolo apparatus 100 of FIG. 2 is illustrated with the bridge backing plate 104 also omitted.

Figure 4:
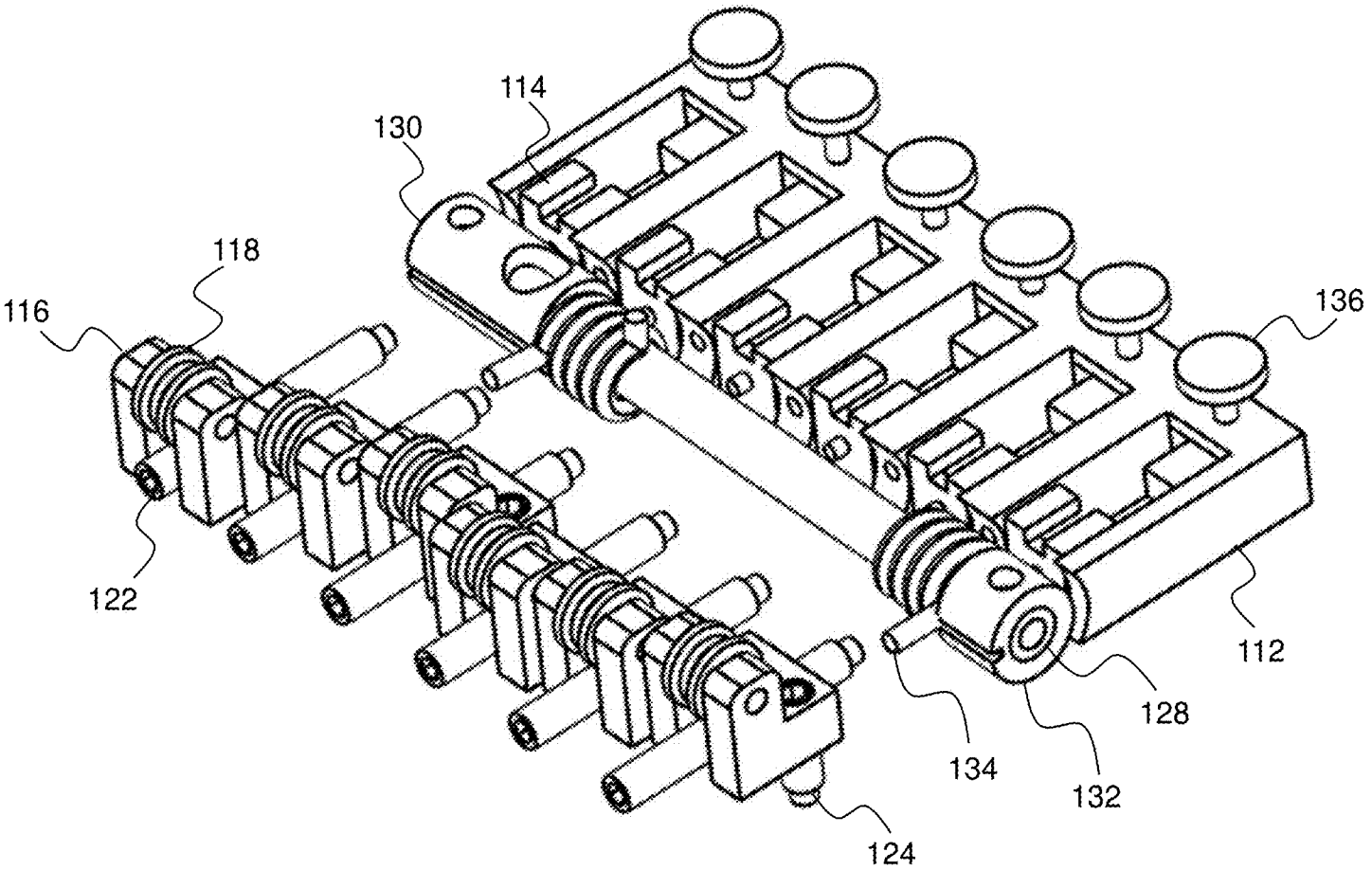

Referring to FIG. 4, the tremolo apparatus 100 of FIG. 3 is illustrated with the cylinder 126 also omitted.

Figure 5:
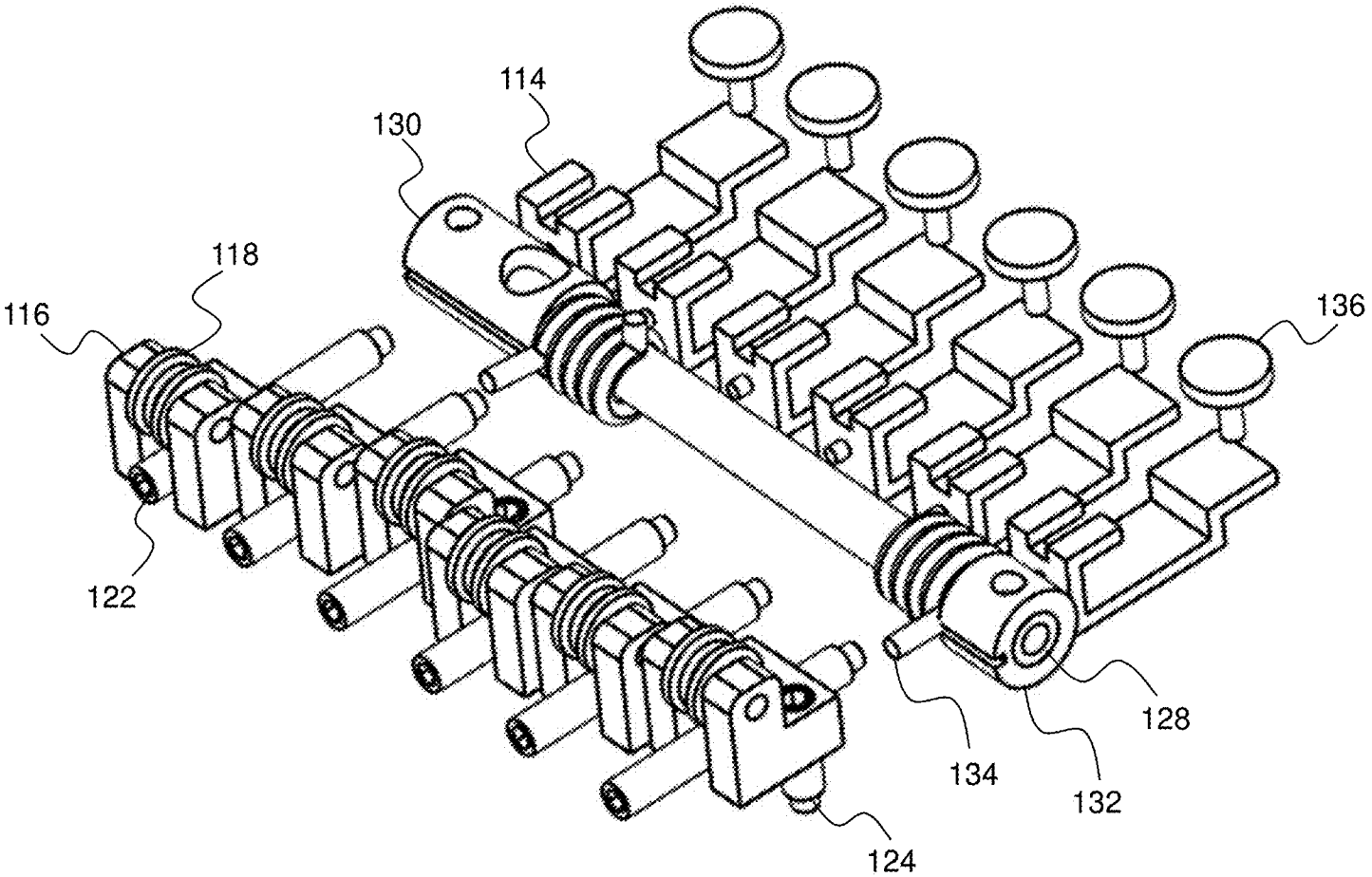

Referring to FIG. 5, the tremolo apparatus 100 of FIG. 4 is illustrated with the back bracket 112 also omitted.

Figure 6A:
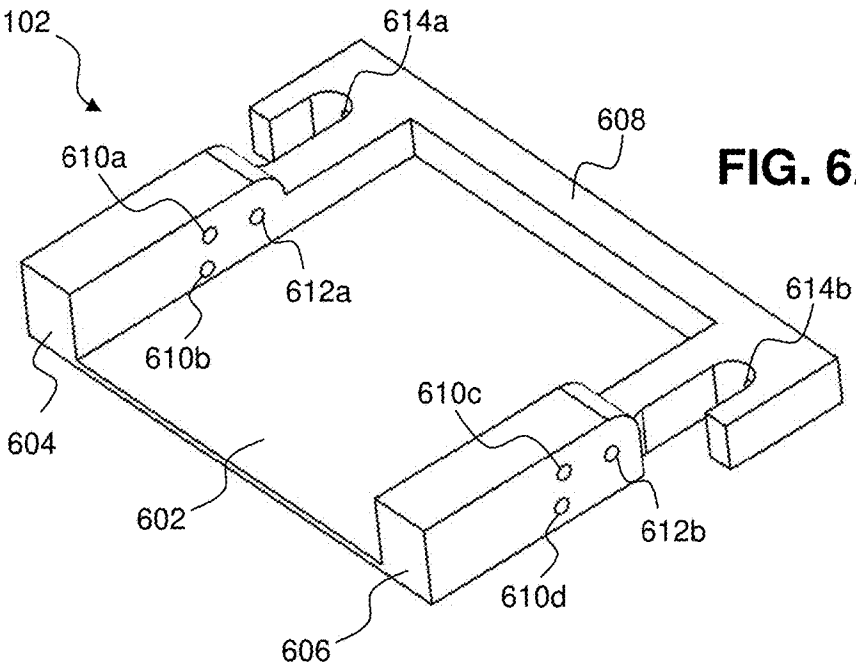
FIGS. 6A and 6B illustrate one embodiment of a baseplate.
Figure 6B:
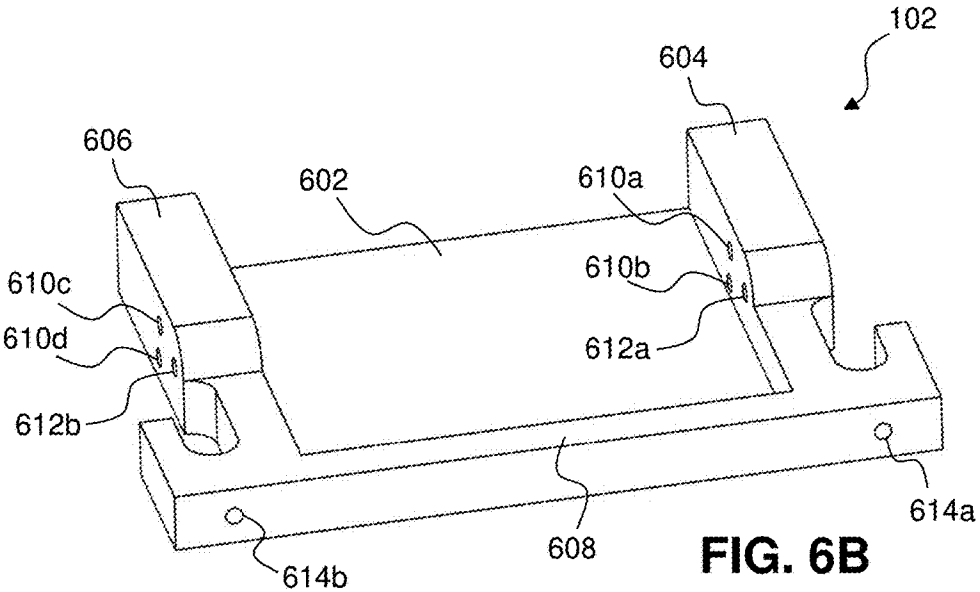

Referring to FIGS. 6A and 6B, one embodiment of the baseplate 102 is illustrated in greater detail with a substantially planar upper surface 602. Sides 604 and 606, with a back 608, form a raised U-shape wall around a portion of the outer edge of the upper surface 602. Mounting holes 610*a* and 610*b* are provided in the side 604 to secure one end of the bridge backing plate 104 to the baseplate 102 using fasteners such as pins or screws. Mounting holes 610*c* and 610*d* are provided in the side 606 to secure the other end of the bridge backing plate 104 to the baseplate 102 using fasteners such as pins or screws. Mounting holes 612*a* and 612*b* in the sides 604 and 606, respectively, are used to rotatably couple the axle 128 to the baseplate 102.

It is understood that the location and number of mounting holes may vary depending on the particular instrument onto which the tremolo apparatus 100 is to be mounted. Accordingly, by varying the number and location of the holes, the tremolo apparatus 100 may be configured for various instruments. In other embodiments, the baseplate 102 may be provided as multiple plates that are individually mounted to the musical instrument, or may be mounted to another mounting plate rather than directly to the instrument. In addition, it is understood that various spacers or other features may be integrated into or otherwise used with the baseplate 102.

Figure 7:
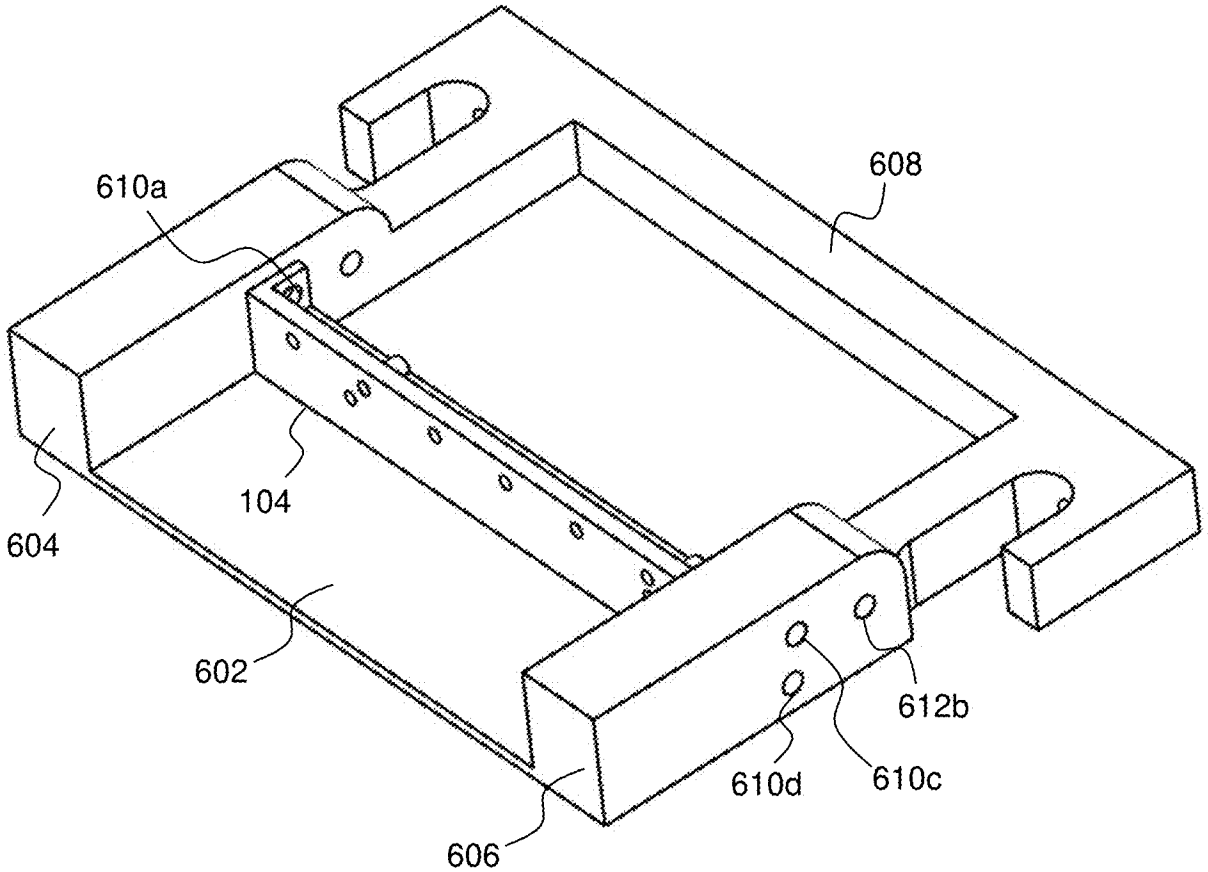
FIG. 7 illustrates the baseplate of FIGS. 6A and 6B with the addition of a bridge backing plate.

Referring to FIG. 7, one embodiment of the baseplate 102 of FIGS. 6A and 6B is illustrated with the addition of a bridge backing plate 104. Although shown as mounted via fasteners, it is understood that the bridge backing plate 104 may be manufactured as a part of the baseplate 102 or may be permanently fixed to the baseplate 102.

Figure 8A:
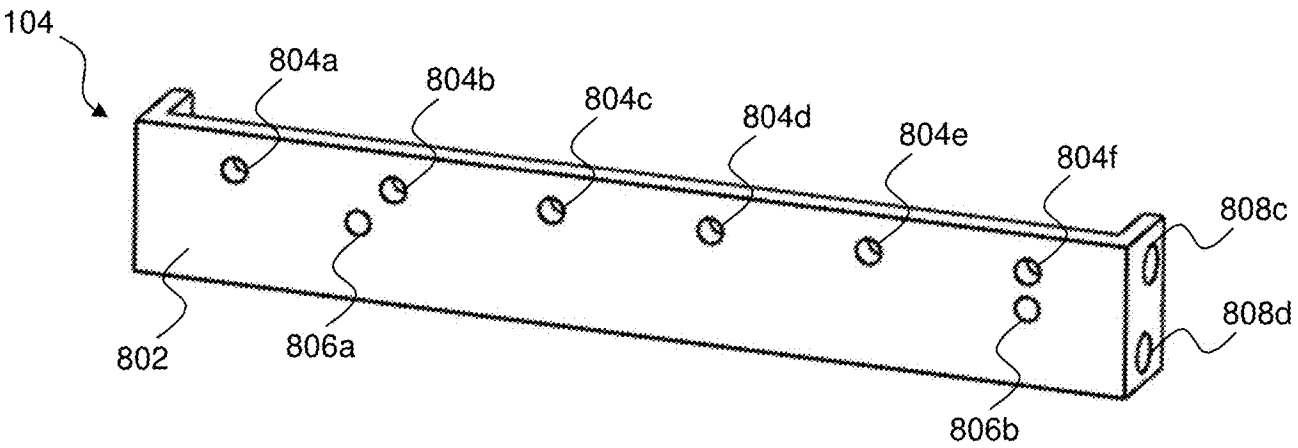
FIGS. 8A and 8B illustrate one embodiment of the bridge backing plate of FIG. 7.
Figure 8B:
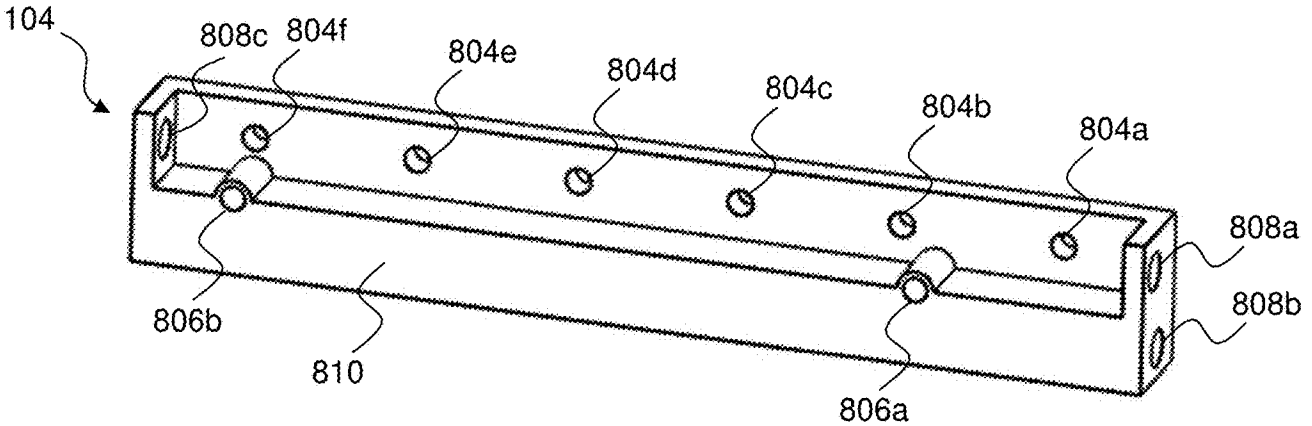

Referring to FIGS. 8A and 8B, one embodiment of the bridge backing plate 104 of FIG. 7 is illustrated in greater detail. The bridge backing plate 104 includes a front surface 802 (i.e., facing the bridge string assemblies 106). Six openings 814*a*-804*f* are positioned to receive the bridge tuning set screws 122 of the bridge string assemblies 106. Two additional openings 806*a* and 806*b* are configured to receive ends of the torsion screws 134. Additional openings 806*a*-808*d* are positioned to correspond to the openings 610*a*-610*d*, respectively, in the baseplate 102 (FIGS. 6A and 6B) in order to receive fasteners to secure the bridge backing plate 104 to the baseplate 102.

Figure 9:
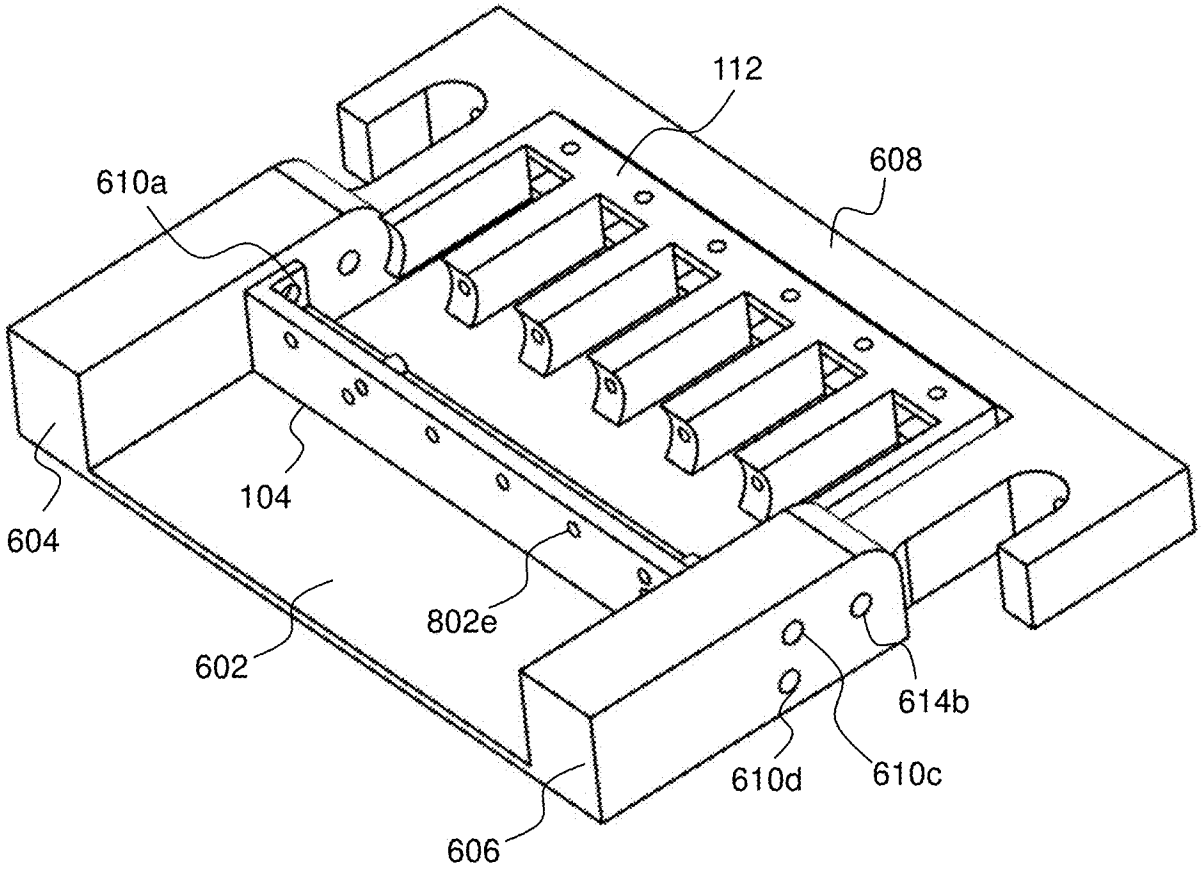
FIG. 9 illustrates the baseplate and bridge backing plate of FIG. 7 with the addition of a back bracket.

Referring to FIG. 9, one embodiment of the baseplate 102 and bridge backing plate 104 of FIG. 7 is illustrated with the addition of a back bracket 112. While the baseplate 102 and the bridge backing plate 104 remain stationary when the cylinder assembly 108 (not shown) is rotated, the back bracket 112 will rotate with the cylinder assembly 108. Accordingly, the back bracket 112 is not coupled to the baseplate 102, but is instead coupled to the cylinder assembly 108.

Figure 10A:
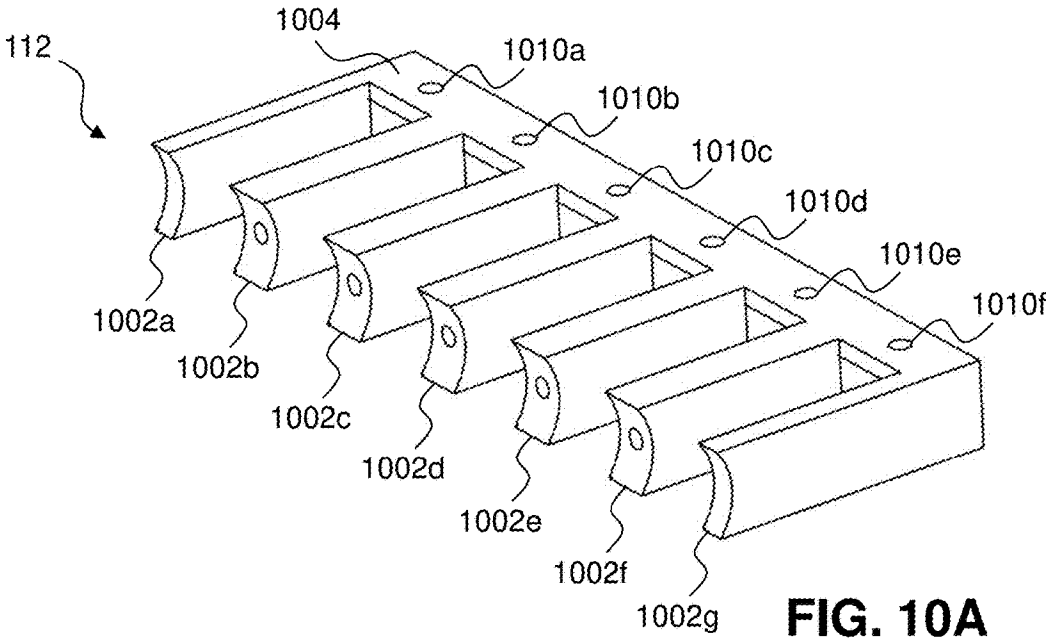
FIGS. 10A-10C illustrate one embodiment of the back bracket of FIG. 9.
Figure 10B:
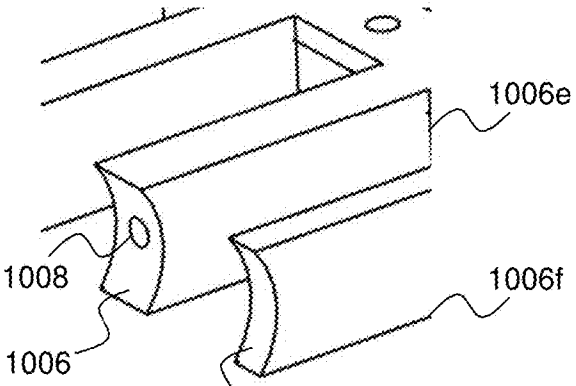
Figure 10C:
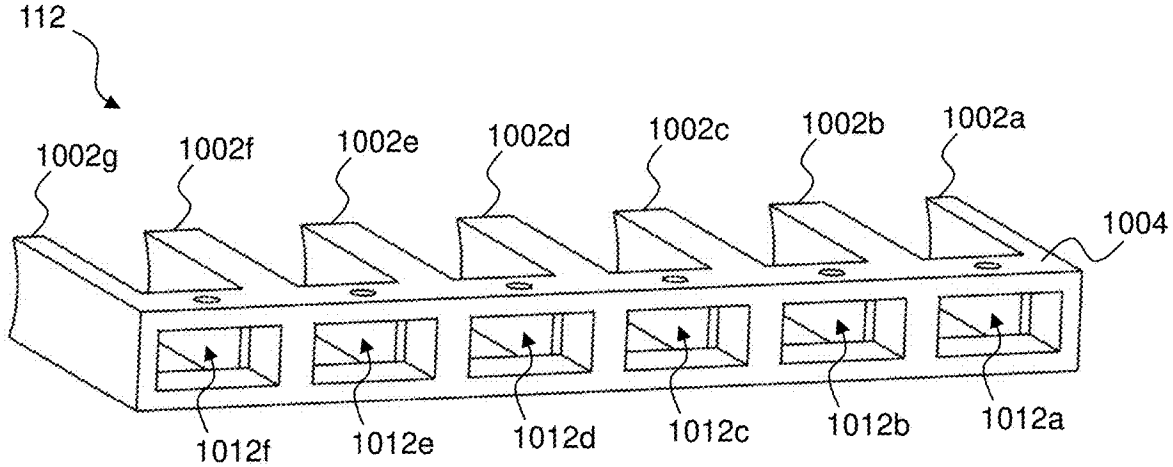

Referring to FIGS. 10A-10C, one embodiment of the back bracket 112 of FIG. 9 is illustrated in greater detail. The back bracket 112 includes multiple extensions or arms 1002*a*-1002*g* that extend from a back portion 1004. The end 1006 of each arm 1002*a*-1002*g* may have a concave curved shape that corresponds to the exterior curvature of the cylinder 126. This enables the arms 1002*a*-1002*g* to fit firmly against the cylinder 126. At least some of the arms 1002*a*-1002*g* may include an opening 1008 to receive a fastener such as a screw to secure the back bracket 112 to the cylinder 126. Alternatively, in other embodiments, some or all of the arms 1002*a*-1002*g* may have a threaded screw portion (not shown) that may be engaged by a nut or another fastener. In some embodiments, some portions or all of the back bracket 112 may be cast or otherwise made as a single piece with the cylinder 126.

Openings 1010*a*-1010*f* enable fine tuning screws 136 (FIG. 1D) to engage string holders 114 (FIG. 1D). Openings 1012*a*-1012*f* in the back portion 1004 are provided to allow the rear portion of each spring holder 114 to be underneath the respective fine tuning screw.

Figure 11:
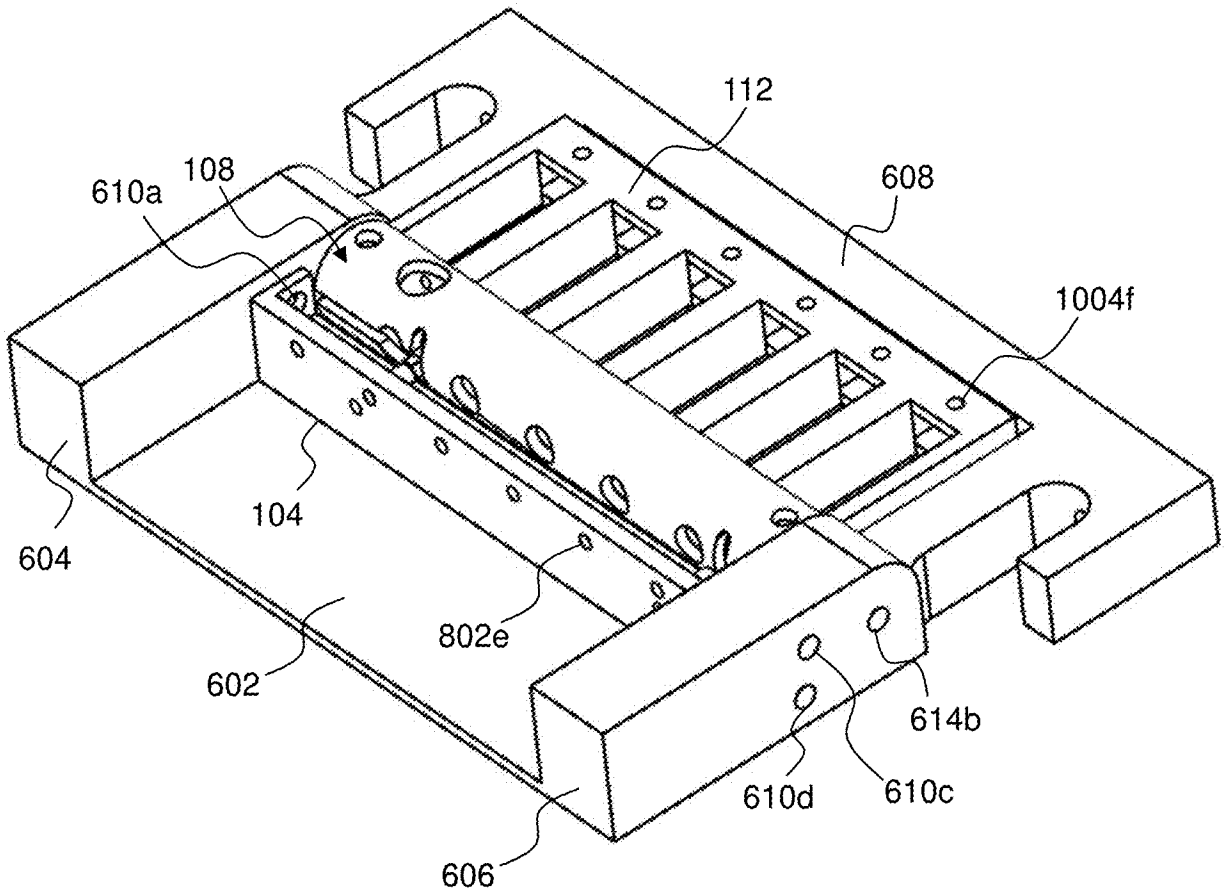
FIG. 11 illustrates the baseplate, bridge backing plate, and back bracket of FIG. 9 with the addition of a cylinder assembly.

Referring to FIG. 11, one embodiment of the baseplate 102, bridge backing plate 104, and back bracket 112 of FIG. 9 is illustrated with the addition of a cylinder assembly 108. The cylinder assembly 108 is rotatably coupled to the baseplate 102, engages the bridge backing plate 104 via springs 134, and is coupled to the back bracket 112 using screws or other fasteners.

Figure 12:
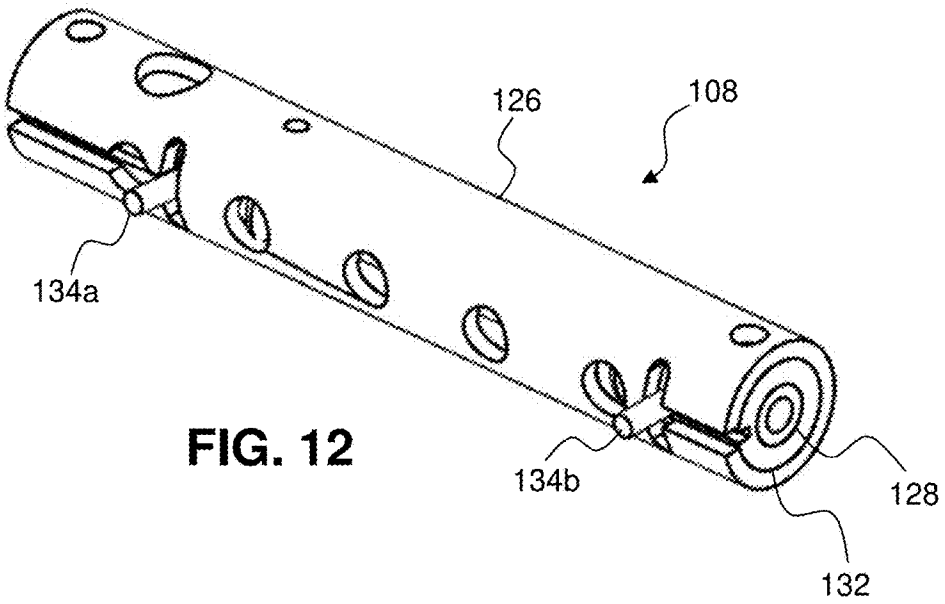
FIGS. 12-15 illustrate embodiments of various portions of the cylinder assembly of FIG. 11.

Referring to FIG. 12, one embodiment of the cylinder assembly 108 of FIG. 11 is illustrated in greater detail. As shown, cylinder 126 forms a cover or sleeve that substantially encloses springs 134*a* and 134*b*, end cap 130 (not shown), end cap 132, and axle 128. Various openings are provided in the cylinder 126, which will be discussed in greater detail below.

Figure 13:
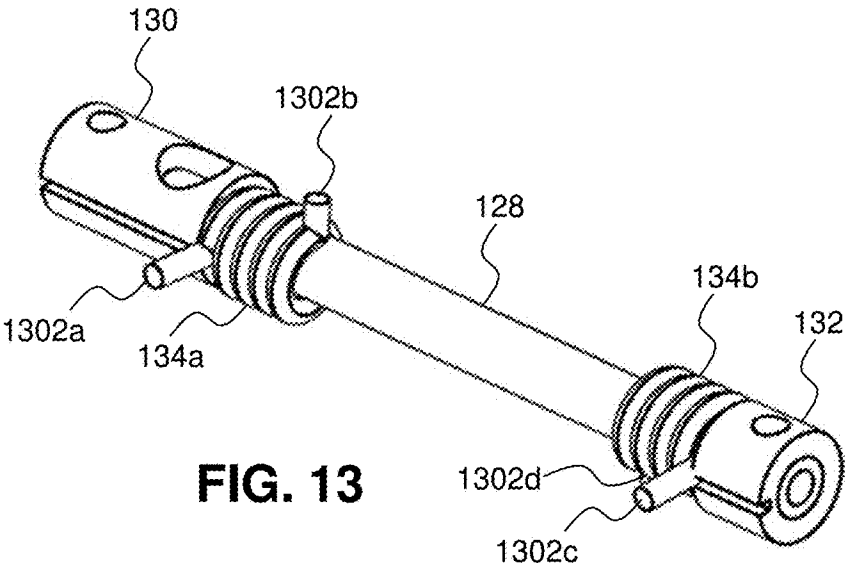

Referring to FIG. 13, a portion of the cylinder assembly 108 of FIG. 12 is illustrated with the cylinder 126 omitted. The end cap 130 provides an internal sleeve coupled to one end of the axle 128 and is coupled to the cylinder 126. Depending on the particular implementation of the cylinder assembly 108, the axle 128 may be stationary or may be configured to rotate (e.g., may be mounted to the baseplate 102 via ball bearings). The end cap 130 also aids in maintain the position of the torsion spring 134*a*. The torsion spring 134 includes a first end 1302*a* that engages opening 806*a* of the bridge backing plate 104 (FIGS. 8A and 8B) and a second end 1302*b* that engages an opening in the cylinder 126.

The end cap 132 provides an internal sleeve coupled to the other end of the axle 128 and is coupled to the cylinder 126, enabling the axle 128 to rotate with the cylinder assembly 108. The end cap 132 also aids in maintain the position of the torsion spring 134*b*. The torsion spring 134*b* includes a first end 1302*c* that engages opening 806*b* of the bridge backing plate 104 (FIGS. 8A and 8B) and a second end 1302*d* that engages an opening in the cylinder 126.

Figure 14:
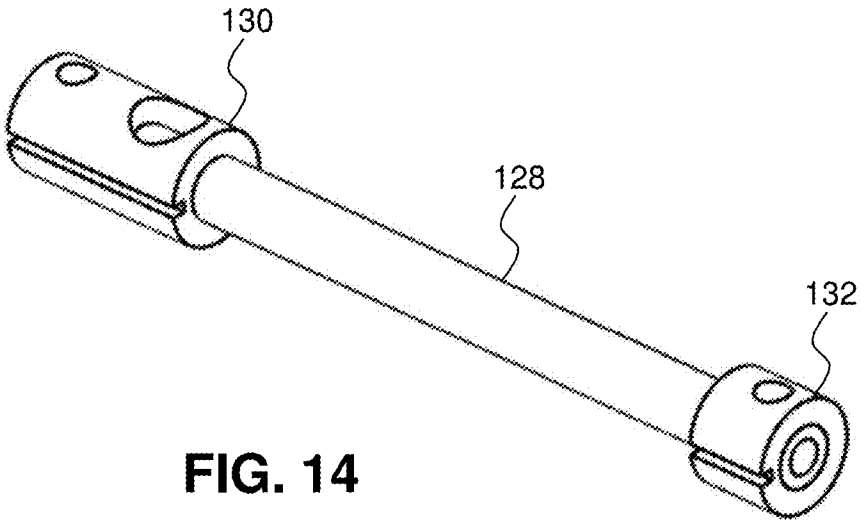

Referring to FIG. 14, a portion of the cylinder assembly 108 of FIG. 11 is illustrated with the torsion springs 134*a* and 134*b* omitted. The end caps 130 and 132 are secured to the axle 128 and rotate when the axle 128 is rotated.

Figure 15:
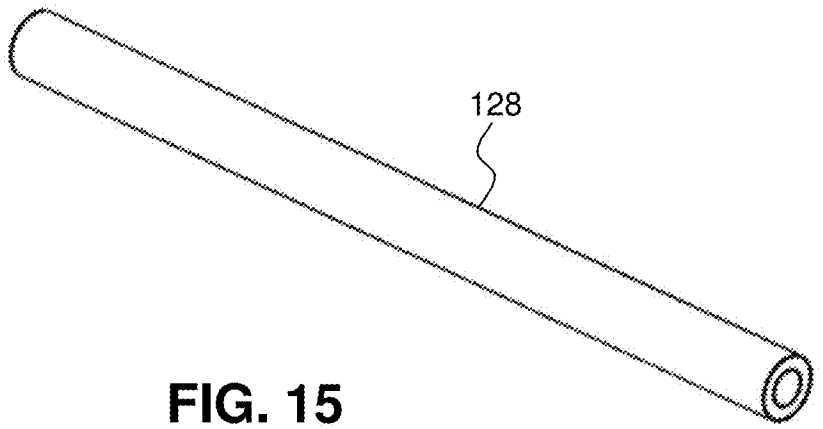

Referring to FIG. 15, the axle 128 of FIGS. 12-14 is illustrated. The ends of the axle may be hollow to receive pins or other fasteners via openings 612*a* and 612*b* in the baseplate 102 (FIGS. 6A and 6B).

Referring to FIGS. 16A-16H, the cylinder 126 of the cylinder assembly 108 of FIG. 12 is illustrated in greater detail. The cylinder 126 includes a bore 1602 that passes entirely through the cylinder, with the diameter of the bore sized to receive the torsion springs 134*a* and 134*b*, and the end caps 130 and 132. An opening 1604 is configured to receive the tremolo arm 110 (FIG. 1D). Openings 1606*a*-1606*d* provide access for fasteners to the end caps 130 and 132, and enable the cylinder 126 to be secured to the end caps and the axle 128. This enables rotation of the entire cylinder assembly 108 when the cylinder 126 is rotated.

Openings 1608*a* and 1608*b* enable the ends 1302*a* and 1302*c* (FIG. 13), respectively, of the springs 134*a* and 134*b* to protrude through the cylinder 126. The openings 1608*a* and 1608*b* are illustrated as slots to enable the cylinder assembly 108 to rotate while the ends 1302*a* and 1302*c*, which are coupled to the non-rotating bridge backing plate 104, remain fixed.

Slots 1610 and 1612 may be used for assembly and filled in using a key or omitted if not needed. Additional openings 1614*a*-1614*e* may be provided for access to the interior of the cylinder 126 for adjusting components, manipulating fasteners such as screws, and/or for other reasons.

In the present example, the openings 1614*a*-1614*e* are positioned opposite openings 1616*a*-1616*e*. The openings 1616*a*-1616*e* are positioned to correspond to the openings 1008 in the arms 1002*b*-1002*f*, respectively, of the back bracket 112 (FIGS. 10A-10C). Fasteners can be passed through the openings 1616*a*-1616*e* and screwed into or otherwise coupled to the arms 1002*b*-1002*f*, with the openings 1614*a*-1614*e* allowing access to the interior of the cylinder 126 to tighten or loosen the screws or otherwise manipulate the fasteners.

Openings 1618*a*-1618*f* are configured to receive extensions (e.g., pins) on string holders 114. In other embodiments, screws or other fasteners may be used. As shown, the cylinder 126 may include one or more grooves or other indentations 1620 to aid in maintaining the position of the instrument strings across the cylinder 126. It is understood that such indentations may be omitted entirely in some embodiments and, when present, may be of varying numbers, depths, widths, and shapes.

Referring to FIGS. 17A-17D, the end cap 130 of the cylinder assembly 108 of FIGS. 13 and 14 is illustrated in greater detail. The end cap 130 includes a bore 1702 sized to receive the axle 128. An opening 1704 receives an end of the tremolo arm 110. Openings 1706*a* and 1706*b* are to be aligned with the openings 1606*a* and 1606*c*, respectively, of the cylinder 126 (FIGS. 16E and 16F) and receive fasteners (e.g., attachment pins) to couple the end cap 130 to the axle 128. A slot 1708 may be provided as a keyway.

Figure 18B:
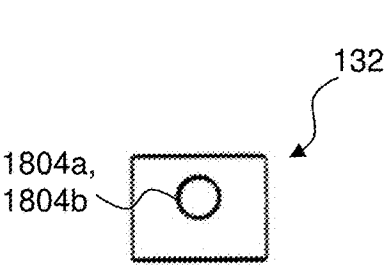
FIGS. 18A-18C illustrate one embodiment of a second end cap of the cylinder assembly of FIGS. 12-14.
Figure 18C:
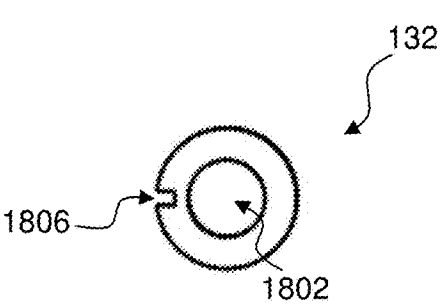
Figure 18A:
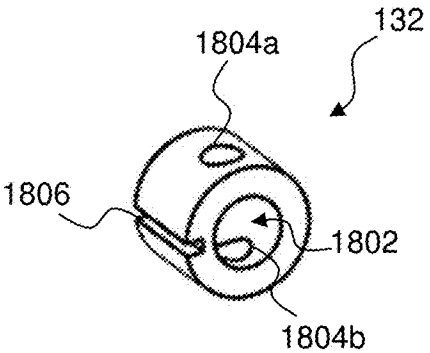
Figure 19B:
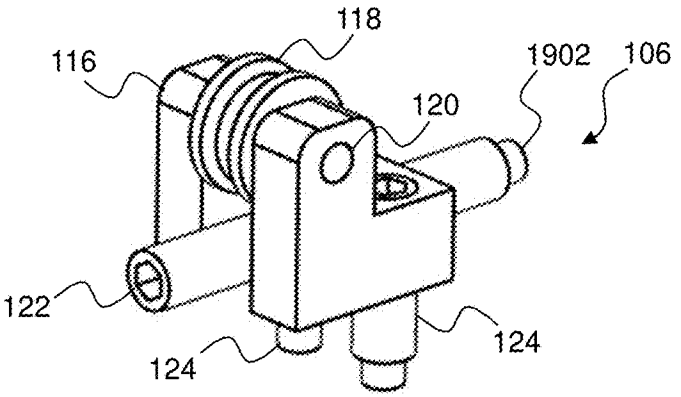
FIGS. 19A-19D illustrate one embodiment of a bridge string assembly.
Figure 19D:
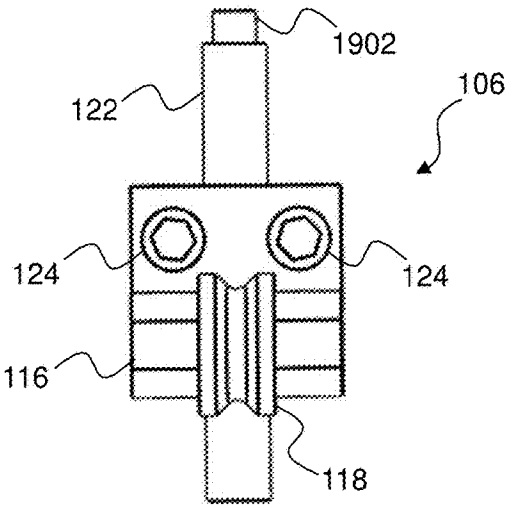
Figure 19A:
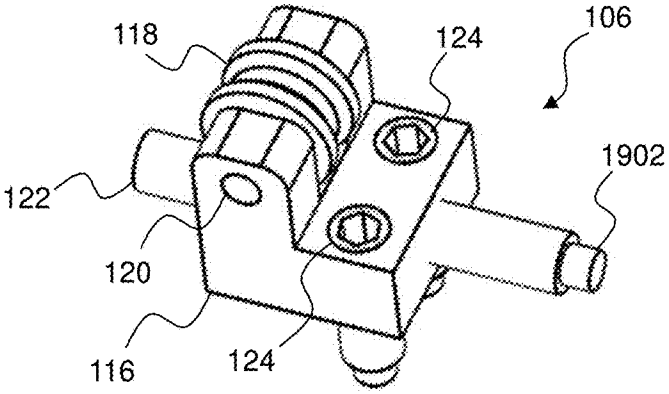
Figure 19C:
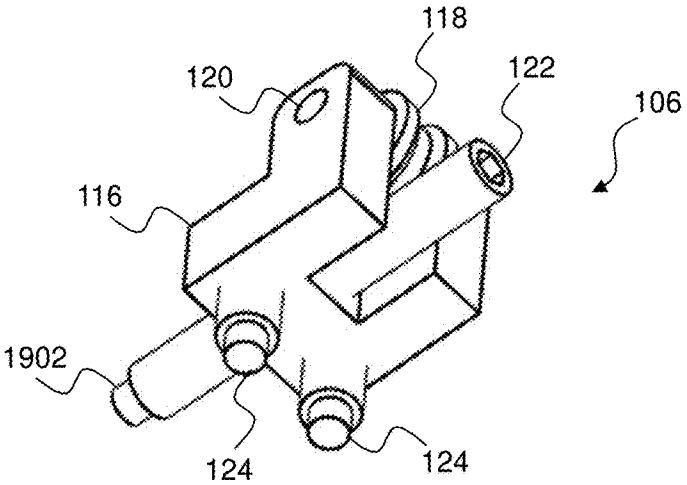

Referring to FIGS. 18A-18C, the end cap 132 of the cylinder assembly 108 of FIGS. 13 and 14 is illustrated in greater detail. The end cap 132 includes a bore 1802 sized to receive the axle 128. Openings 1804*a* and 1804*b* are to be aligned with the openings 1606*b* and 1606*d*, respectively, of the cylinder 126 (FIGS. 16E and 16F) and receive fasteners to couple the end cap 132 to the axle 128. A slot 1806 may be provided as a keyway.

Referring to FIGS. 19A-19D, one embodiment of the bridge string assembly 106 of FIG. 1D is illustrated in assembled form. The bridge string assembly 106 includes a bridge bracket 116 that rotatably engages a bridge string support 118 using a pin 120. One or more bridge height set screws 124 may be used to adjust the positioning of the bridge bracket 116 vertically relative to the baseplate 102. The bridge height set screws 124 are threaded and engage corresponding threads in the bridge bracket 116.

A bridge tuning set screw 122 engages one of the openings 804*a*-804*f* in the bridge backing plate 104 (FIGS. 8A and 8B) and may be used to adjust the positioning of the bridge bracket 116 horizontally relative to the bridge backing plate 104. The bridge tuning set screw 122 is threaded and engages corresponding threads in the bridge bracket 116. In some embodiments, the bridge tuning set screw 122 may include a smaller end 1902 that is sized for the openings 804*a*-804*f*. The bridge tuning set screw 122 may be secured to the bridge backing plate 104 via a snap ring or by other means.

Figure 20B:
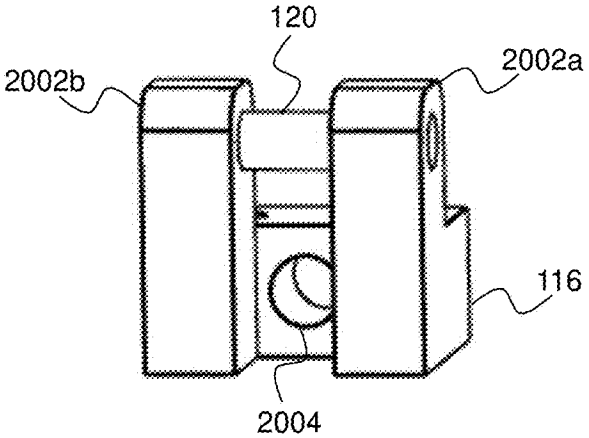
FIGS. 20A and 20B illustrate a bracket and pin of the bridge string assembly of FIGS. 19A-19D.
Figure 20A:
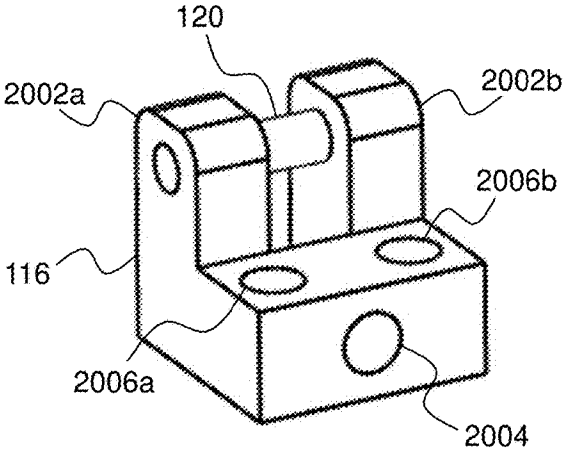

Referring to FIGS. 20A and 20B, the bridge bracket 116 and pin 120 are illustrated. The bridge bracket 116 may include two extensions or arms 2002*a* and 2002*b* with holes positioned therein to support the pin 120. An opening 2004 may be provided for the bridge tuning set screw 122. Openings 2006*a* and 2006*b* may be used for the bridge height set screws 124.

Figure 21B:
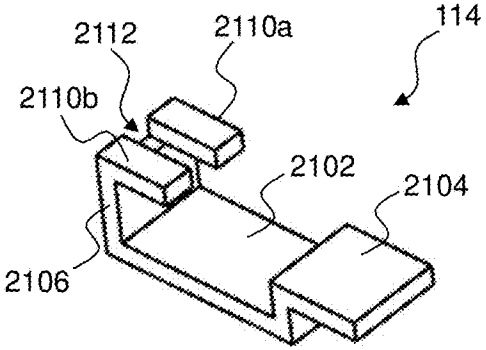
FIGS. 21A and 21B illustrate one embodiment of a string holder.
Figure 21A:
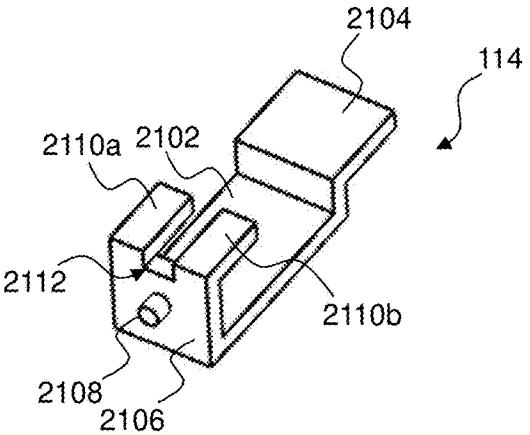

Referring to FIGS. 21A and 21B, one embodiment of the string holder 114 of FIG. 1D is illustrated. The string holder 114 includes a base portion 2102 that is coupled to a tail portion 2104. The tail portion 2104 has a horizontal bar or plate that fits into one of the openings 1012*a*-1012*f* of the back bracket 112 (FIG. 10C) and may be pressed down by a fine tuning screw 136 (if present).

Figure 16A:
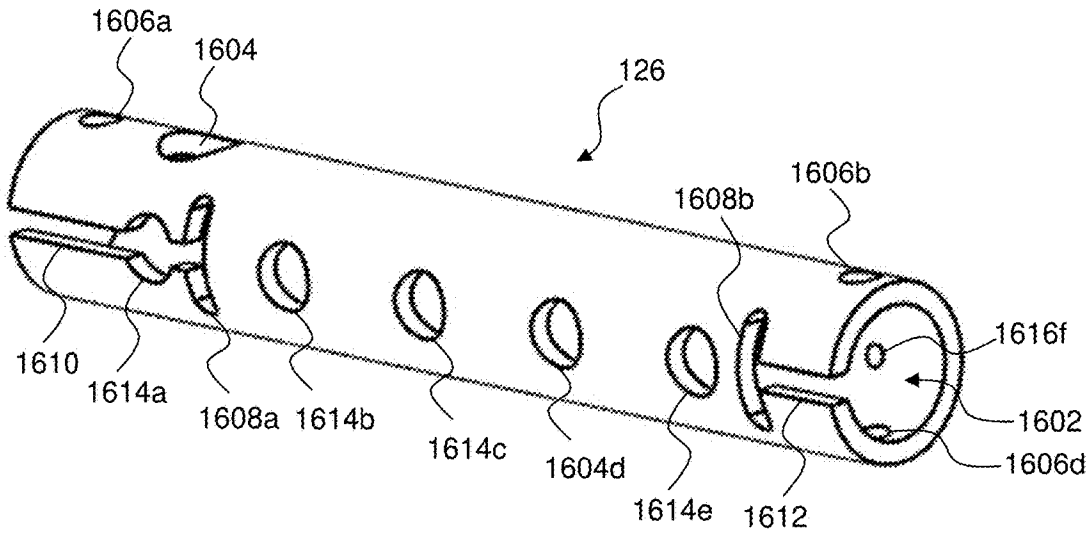
FIGS. 16A-16H illustrate one embodiment of a main or outer cylinder of the cylinder assembly of FIGS. 12-14.
Figure 16B:
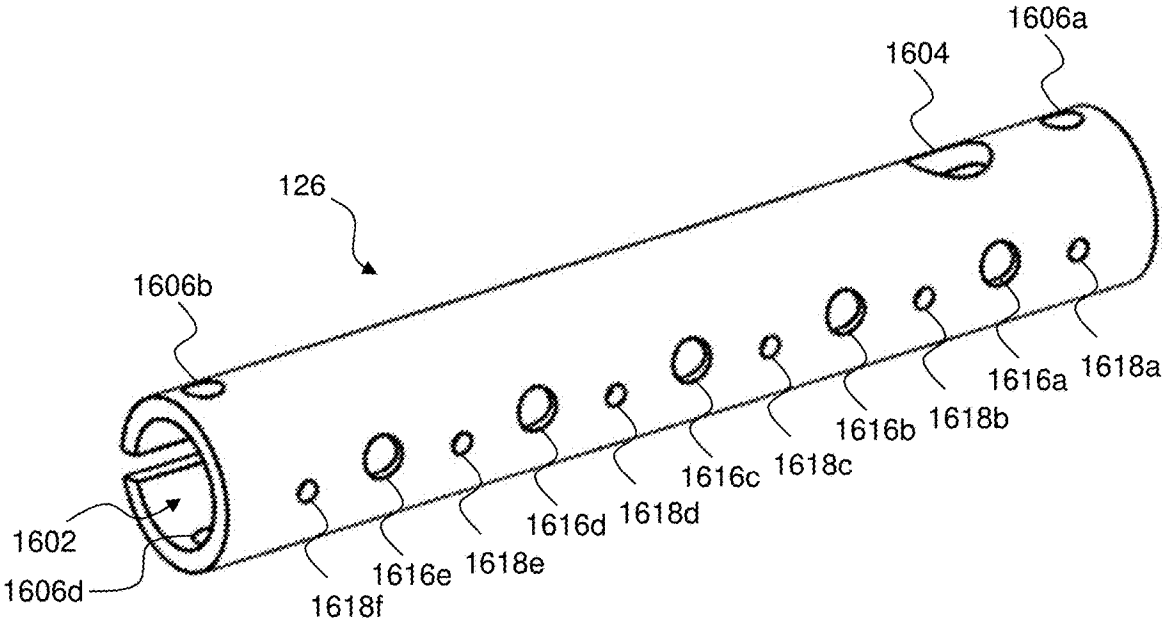
Figure 16C:
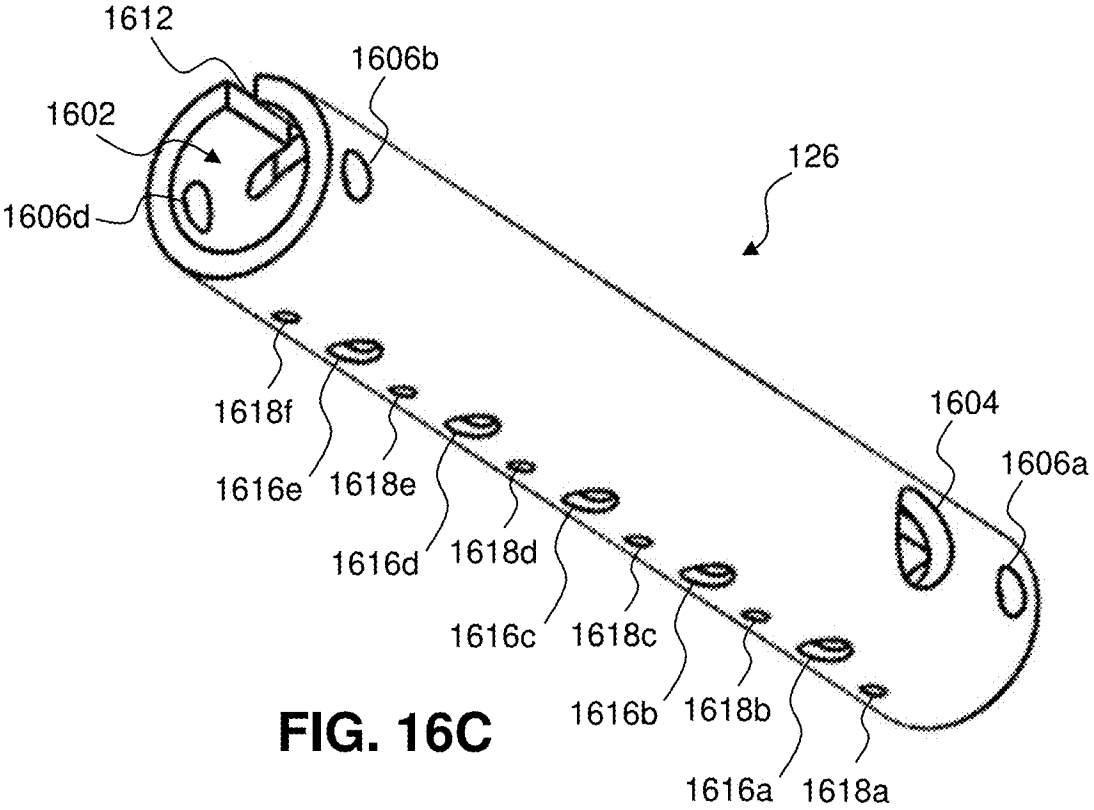
Figure 16D:
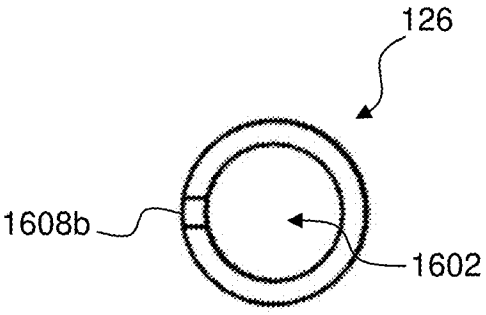
Figures 16E, 16F, 16G, 16H:
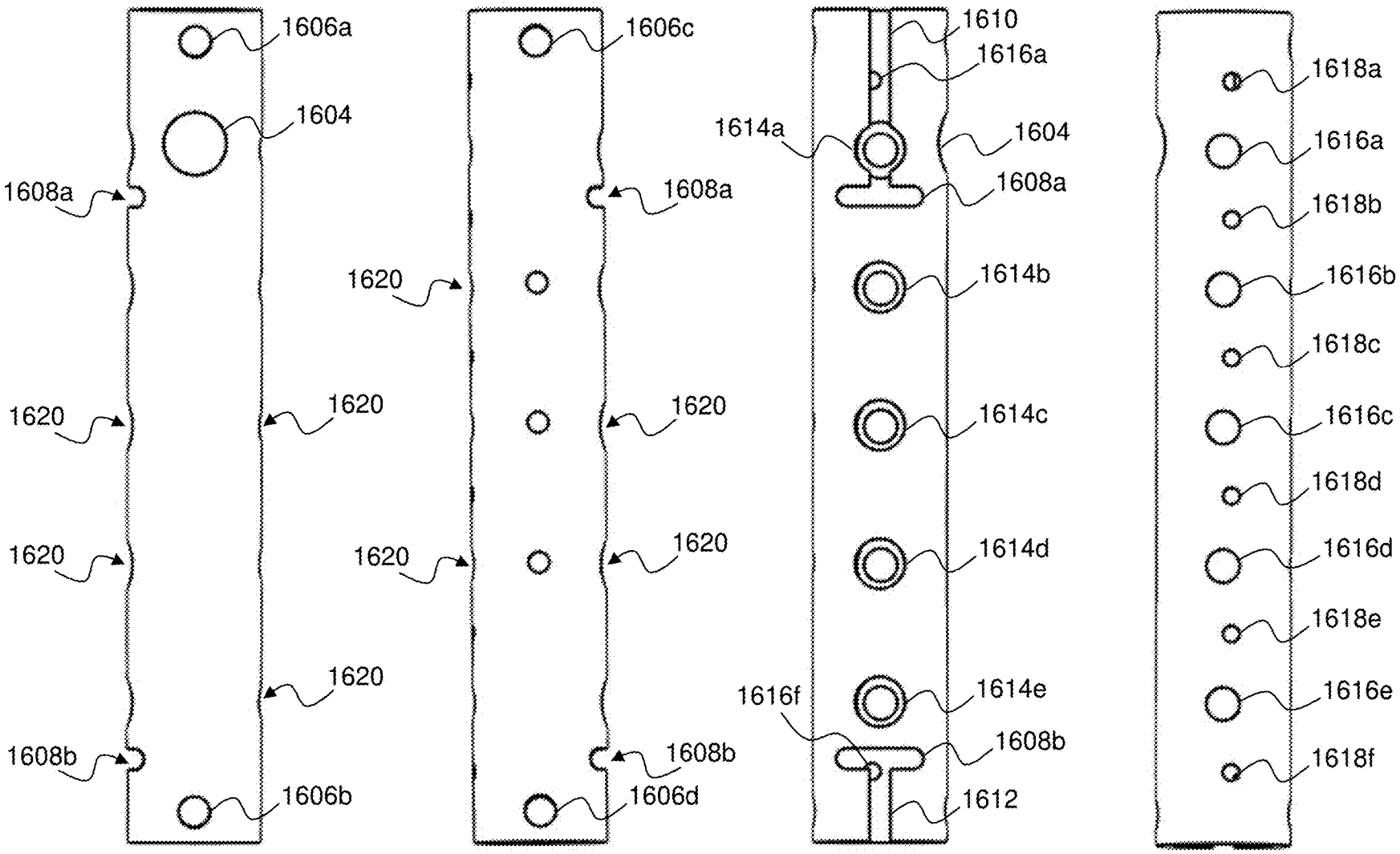
Figure 17A:
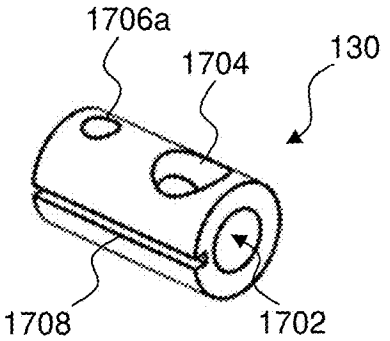
FIGS. 17A-17D illustrate one embodiment of a first end cap of the cylinder assembly of FIGS. 12-14.
Figure 17B:
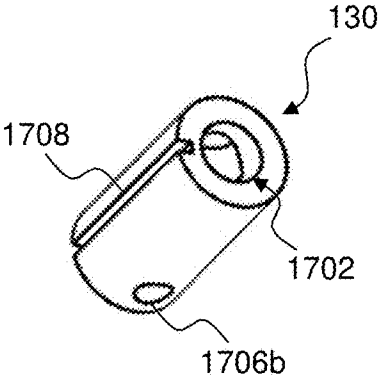
Figure 17C:
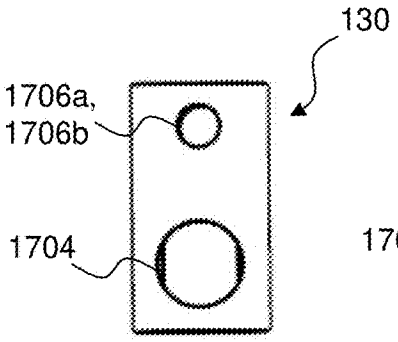
Figure 17D:
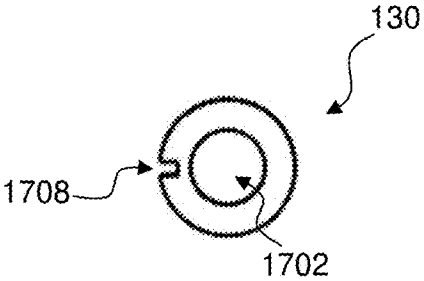

On the opposite end from the tail portion 2104, a vertical portion 2106 includes an extension or pin 2108 that faces the cylinder 126 when the tremolo assembly 100 is assembled. The pin 2108 fits into one of the openings 1618*a*-1618*f* of the cylinder 126 (FIG. 16B). Two arms 2110*a* and 2110*b* extend from the vertical portion 2106 and form a slot 2112. In the present example, the arms 2110*a* and 2110*b* extend backwards towards the tail portion 2104. The arms 2110*a* and 2110*b* serve to capture a ball end (e.g., a bead) of a musical instrument string (not shown), with the string passing through the slot. It is understood that the arms 2110*a* and 2110*b* may be shaped differently (e.g., curved and/or angled) and other capture mechanisms may be used. For example, a string clamp may be used to secure the string with or without a bead.

Figure 22:
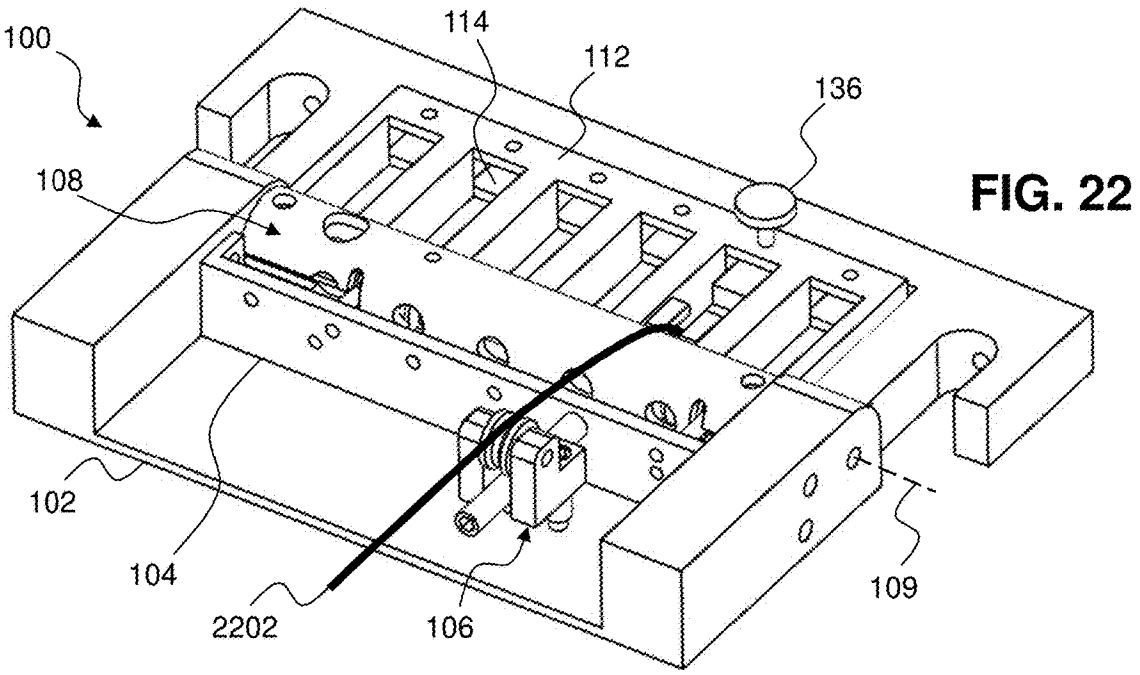
FIGS. 22 and 23 illustrate different views of a bridge string assembly, a cylinder assembly, a string holder, and other components with single musical instrument string.

Referring to FIG. 22, one embodiment of a partially assembled tremolo 100 is illustrated with a bridge string assembly 106 coupled to the bridge backing plate 104. The cylinder assembly 108 has engaged the bridge backing plate 104 by torsion spring ends as described previously. The back bracket 112 has string mounts 114 positioned therein, with a fine tuning screw 136 positioned above the string mount 114 corresponding to the bridge string assembly 106. A guitar string 2202 is positioned across the bridge string support 118 and the cylinder 126 of the cylinder assembly 108, with the end being retained in the string mount 114.

Figure 23:
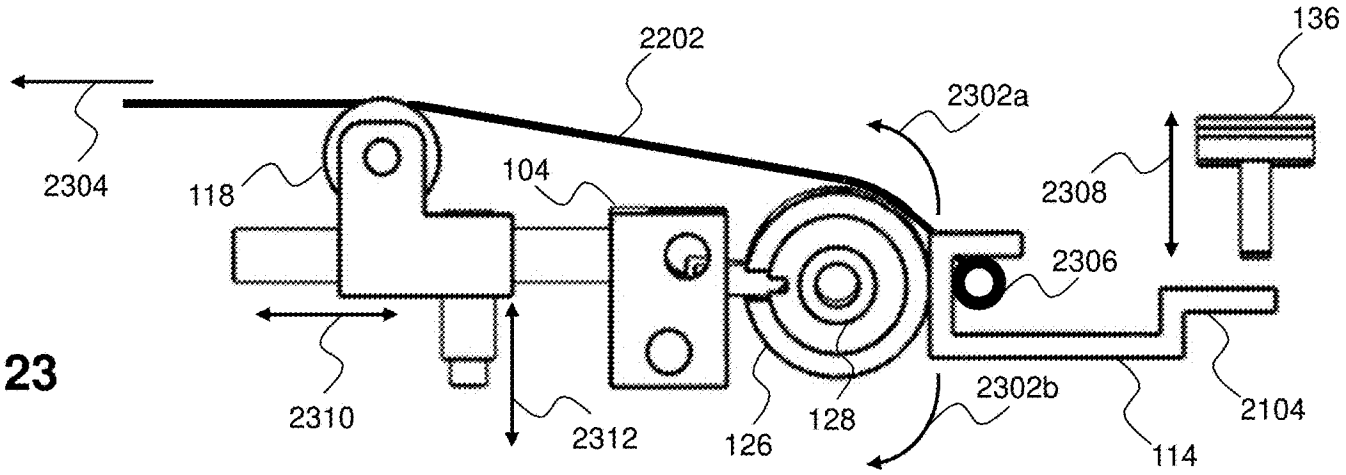

Referring to FIG. 23, the components of FIG. 22 are illustrated in a side view with the baseplate 102 omitted. As shown, the cylinder 126 is able to rotate around an axis of rotation provided by the axle 128 (as indicated by arrows 2302*a* and 2302*b*) while the bridge backing plate 104 and the bridge string assembly 106 remain stationary. The guitar string 2202 is under tension (as indicated by arrow 2304) and, since it is locked into the string holder 114 via the string's ball end 2306, exerts pressure to rotate the string holder 114 (and therefore the cylinder 126 to which the string holder is attached) in the direction of the arrow 2302*a*.

The fine tuning screw 136 moves vertically with respect to the tail portion 2104 of the string holder 114 (as indicated by arrow 2308) and may engage the tail portion. By regulating the vertical movement of the tail portion 2104, the fine tuning screw 136 operates to counteract the rotational bias imparted by the guitar spring 2202. This enables the fine tuning screw 136 to be used to make minor adjustments to the angle of the tail portion 2104 (and to the orientation of the string holder 114), and therefore to the tension of the guitar string 2202.

Although not part of the rotating portion of the tremolo 100, the bridge string assembly 106 may be moved horizontally and vertically with respect to the baseplate 102 as indicated by arrows 2310 and 2312, respectively. This enables the bridge string assembly 106 to be adjusted within an available range with respect to where it supports the guitar string 2202.

Figure 24:
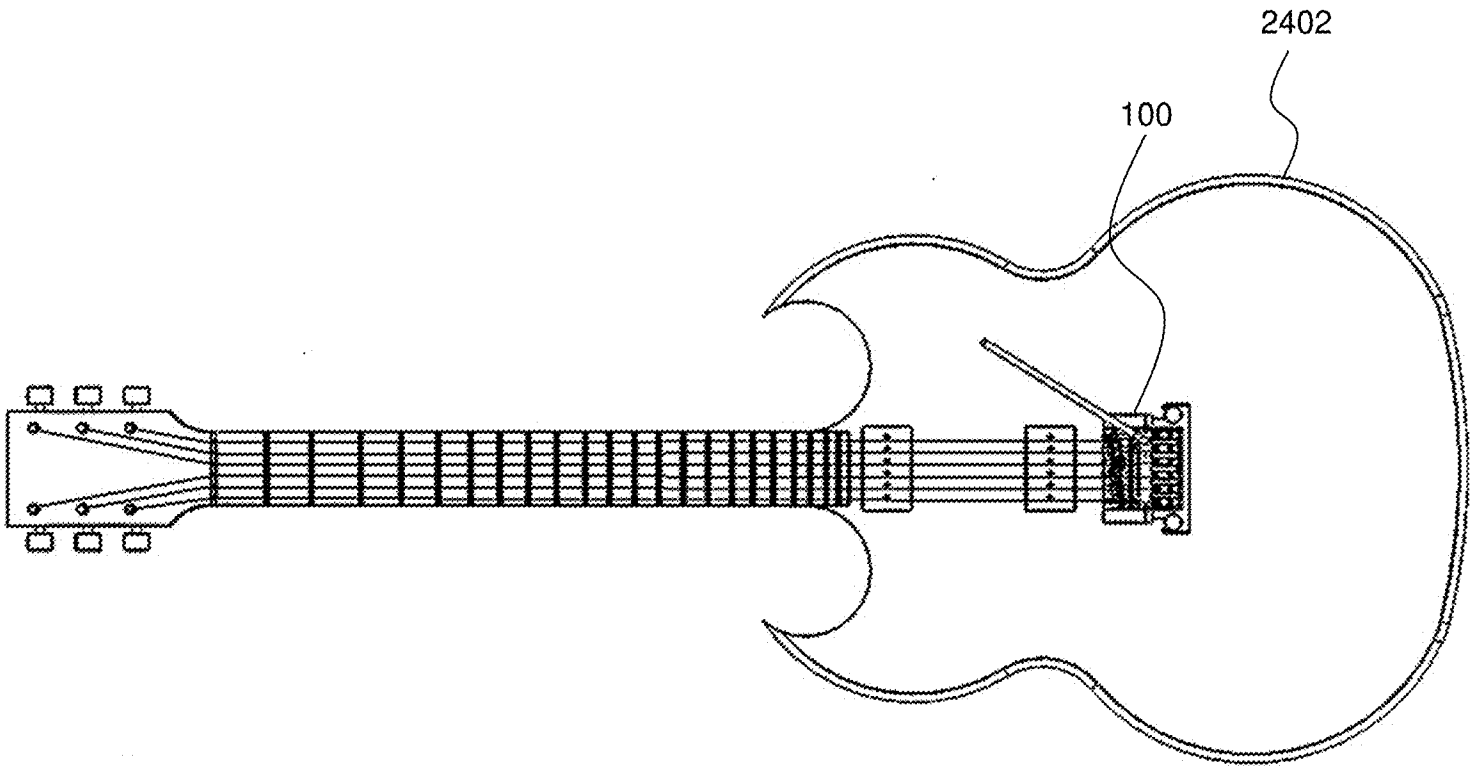
FIG. 24 illustrates one embodiment of a tremolo apparatus mounted on a guitar.

Referring to FIG. 24, one embodiment of the tremolo apparatus 100 is illustrated as mounted on a guitar 2402.

Any advantages and benefits described may not apply to all embodiments of the invention. When the word "means" is recited in a claim element, Applicant intends for the claim element to fall under 35 USC 112(f). Often a label of one or more words precedes the word "means". The word or words preceding the word "means" is a label intended to ease referencing of claims elements and is not intended to convey a structural limitation. Such means-plus-function claims are intended to cover not only the structures described herein for performing the function and their structural equivalents, but also equivalent structures. For example, although a nail and a screw have different structures, they are equivalent structures since they both perform the function of fastening. Claims that do not use the word "means" are not intended to fall under 35 USC 112(f).

The foregoing description of the embodiments of the invention has been presented for the purposes of illustration and description. It is not intended to be exhaustive or to limit the invention to the precise form disclosed. Many combinations, modifications and variations are possible in light of the above teaching. For instance, in certain embodiments, each of the above described components and features may be individually or sequentially combined with other components or features and still be within the scope of the present invention. Undescribed embodiments which have interchanged components are still within the scope of the present invention. It is intended that the scope of the invention be limited not by this detailed description, but rather by the claims.

What is claimed is:

1. A tremolo apparatus for a string musical instrument comprising:

a baseplate for attaching the tremolo apparatus to a musical instrument;

at least one bridge string support assembly coupled to the baseplate, wherein the bridge string support assembly is configured to support at least one instrument string;

a cylinder assembly rotatably coupled to the baseplate;

at least one torsion device positioned to impart torsional force on the cylinder assembly relative to the baseplate; and a plurality of string holders coupled to the cylinder assembly, wherein each string holder is configured to secure an instrument string with a desired amount of string tension when the cylinder assembly is in a first position relative to the baseplate, and wherein the string holders are configured to rotate relative to the baseplate when the cylinder assembly is rotated.

2. The tremolo apparatus of claim 1 further comprising a back bracket coupled to the cylinder assembly, wherein the back bracket retains the string holders and is configured to rotate relative to the baseplate with the cylinder assembly.

3. The tremolo apparatus of claim 2 further comprising a fine tuning screw that passes through an opening in the back bracket to engage one of the string holders in order to regulate the tension of the instrument string secured in the string holder by altering the string holder's orientation relative to the cylinder assembly.

4. The tremolo apparatus of claim 1 further comprising a bridge backing plate coupled to the baseplate, wherein the bridge string support assembly is coupled to the bridge backing plate and not directly to the baseplate.

5. The tremolo apparatus of claim 4 wherein the bridge string support assembly is movably coupled to the bridge backing plate using a threaded screw, wherein rotation of the threaded screw moves the bridge string support assembly horizontally relative to an upper surface of the baseplate and increases or decreases the distance from the bridge string support assembly to the bridge backing plate.

6. The tremolo apparatus of claim 1 wherein the bridge string support assembly is vertically adjustable relative to an upper surface of the baseplate.

7. The tremolo apparatus of claim 1 wherein the bridge string support assembly supports the instrument string on a grooved wheel that is rotatably coupled to a bracket of the bridge string support assembly.

8. The tremolo apparatus of claim 1 wherein the torsion device is part of the cylinder assembly.

9. The tremolo apparatus of claim 1 wherein the torsion device is a spring.

10. The tremolo apparatus of claim 1 wherein the cylinder assembly includes:

a cylinder having an axle disposed therein, wherein the cylinder and the axle share a longitudinal axis;

the axle; and first and second end caps retaining a position of the axle within the cylinder, wherein the cylinder is coupled to the first and second end caps.

11. The tremolo apparatus of claim 10 wherein the cylinder assembly further includes a torsion device.

12. The tremolo apparatus of claim 1 further comprising a tremolo arm coupled to the cylinder assembly and configured to rotate the cylinder assembly relative to the baseplate to modify the tension of the instrument strings when force is applied to the tremolo arm.

13. The tremolo apparatus of claim 1 wherein the baseplate is configured to be mounted on the musical instrument without modifications to the musical instrument.

14. The tremolo apparatus of claim 1 wherein the mounting plate is surface mounted.

15. A tremolo apparatus for a string musical instrument comprising:

a baseplate for attaching the tremolo apparatus to a musical instrument;

a bridge string support assembly coupled to the baseplate and configured to support an instrument string;

a cylinder rotatably coupled to the baseplate;

a torsion device positioned to impart torsional force on the cylinder relative to the baseplate; and a string holder coupled to the cylinder and configured to secure an instrument string with a desired amount of string tension when the cylinder assembly is in a first position relative to the baseplate.

16. The tremolo apparatus of claim 15 wherein the cylinder is part of a cylinder assembly that includes:

the cylinder;

an axle disposed within the cylinder; and first and second end caps retaining a position of the axle within the cylinder.

17. The tremolo apparatus of claim 16 wherein the torsion device is part of the cylinder assembly.

18. The tremolo apparatus of claim 15 wherein the torsion device is a spring.

19. The tremolo apparatus of claim 15 wherein the baseplate is configured to be mounted on the musical instrument without modifications to the musical instrument.

20. The tremolo apparatus of claim 15 wherein the mounting plate is surface mounted.

* * * * *